US011486646B2

(12) United States Patent
Vouche et al.

(10) Patent No.: US 11,486,646 B2
(45) Date of Patent: Nov. 1, 2022

(54) AIR-COOLED CONDENSER APPARATUS AND METHOD

(71) Applicant: SPG DRY COOLING BELGIUM, Brussels (BE)

(72) Inventors: Michel Vouche, Marbais (BE); Gwenael Vanden Borre, Etterbeek (BE)

(73) Assignee: SPG Dry Cooling Belgium, Brussels (BE)

( * ) Notice: Subject to any disclaimer, the term of this patent is extended or adjusted under 35 U.S.C. 154(b) by 366 days.

(21) Appl. No.: 16/303,526

(22) PCT Filed: May 19, 2017

(86) PCT No.: PCT/EP2017/062162
§ 371 (c)(1),
(2) Date: Nov. 20, 2018

(87) PCT Pub. No.: WO2017/202730
PCT Pub. Date: Nov. 30, 2017

(65) Prior Publication Data

US 2020/0278154 A1 Sep. 3, 2020

(30) Foreign Application Priority Data

May 25, 2016 (EP) ..... 16171343

(51) Int. Cl.
*F25B 39/04* (2006.01)
*F25B 7/00* (2006.01)
(Continued)

(52) U.S. Cl.
CPC ..... *F28B 1/06* (2013.01); *F28F 9/002* (2013.01); *F01P 2070/52* (2013.01);
(Continued)

(58) Field of Classification Search
CPC ..... F28B 1/06; F28B 9/00; F28B 9/02; F28B 9/04; F28B 7/00; F25B 39/04;
(Continued)

(56) References Cited

U.S. PATENT DOCUMENTS 3,204,693 A 9/1965 Kuhn
3,384,165 A 5/1968 Mathews
(Continued)

FOREIGN PATENT DOCUMENTS

CN 1185205 6/1998
CN 101568790 10/2009
(Continued)

OTHER PUBLICATIONS

International Searching Authority, "Search Report and Written Opinion," issued in connection with PCT patent application No. PCT/EP2017/062162, dated Aug. 11, 2017, 8 pages.

*Primary Examiner* — Frantz F Jules
*Assistant Examiner* — Jason N Thompson
(74) *Attorney, Agent, or Firm* — Hanley, Flight & Zimmerman, LLC

(57) ABSTRACT

The present invention relates to an air-cooled condenser apparatus for condensing a steam flow exiting a turbine from for example a power plant. The air-cooled condenser apparatus comprises a series of condenser modules, each module having a series of compact delta-type heat exchanger units and a series of fans. The air-cooled condenser apparatus further comprises a series of independent frame structures FRS(m) wherein the number of frame structures has a lower limit depending on the number of modules. The invention further relates to a method for manufacturing an air-cooled condenser apparatus comprising steps of manufacturing the delta-type heat exchanger units in the factory, placing the
(Continued)

units in a container for transportation and erecting the air-cooled condenser apparatus at a site of installation.

11 Claims, 15 Drawing Sheets

(51) Int. Cl.

| | |
|---|---|
| ***F28B 1/06*** | (2006.01) |
| ***F28B 9/00*** | (2006.01) |
| ***F28B 9/02*** | (2006.01) |
| ***F28B 9/04*** | (2006.01) |
| ***F24F 1/14*** | (2011.01) |
| ***F28D 1/02*** | (2006.01) |
| ***F28F 9/00*** | (2006.01) |
| *F28D 1/04* | (2006.01) |
| *F28F 1/12* | (2006.01) |

(52) U.S. Cl.
CPC ..... *F25B 39/04* (2013.01); *F28B 2001/065* (2013.01); *F28D 1/0435* (2013.01); *F28F 1/126* (2013.01)

(58) Field of Classification Search
CPC ..... F25B 2339/04; F25B 2210/10; F25B 2339/045; F24F 1/14; F28D 2001/0266; F28D 2001/0273
USPC ..... 165/47, 67, 68, 120, 124, 125
See application file for complete search history.

(56) References Cited

U.S. PATENT DOCUMENTS

| | | | | |
|---|---|---|---|---|
| 3,519,068 | A | 7/1970 | Harris et al. | |
| 3,685,579 | A | 8/1972 | Spangemacher | |
| 3,707,185 | A * | 12/1972 | Modine | F25B 39/04 165/122 |
| 3,976,127 | A | 8/1976 | Harris | |
| 4,076,771 | A | 2/1978 | Houx, Jr. et al. | |
| 4,108,240 | A * | 8/1978 | Margen | B21D 53/027 165/125 |
| 4,367,183 | A | 1/1983 | Carbonaro | |
| 4,513,813 | A | 4/1985 | Zanobini | |
| 4,913,710 | A | 4/1990 | Reverdv | |
| 4,926,931 | A | 5/1990 | Larinoff | |
| 4,949,543 | A | 8/1990 | Cottone et al. | |
| 5,007,501 | A | 4/1991 | Baston | |
| 5,098,006 | A | 3/1992 | McManus | |
| 5,301,746 | A | 4/1994 | Trage et al. | |
| 5,715,889 | A * | 2/1998 | Peterson | F25B 39/00 165/67 |
| 5,851,446 | A | 12/1998 | Bardo et al. | |
| 5,902,522 | A | 5/1999 | Seawell et al. | |
| 5,950,717 | A * | 9/1999 | Fay | F28B 9/08 165/113 |
| 5,966,809 | A | 10/1999 | Pierce | |
| 6,378,605 | B1 * | 4/2002 | Kutscher | F28B 1/06 165/181 |
| 6,474,272 | B2 | 11/2002 | Bensing et al. | |
| 7,610,949 | B2 | 11/2009 | Palanchon | |
| 7,926,555 | B2 * | 4/2011 | Sanderlin | F28B 11/00 165/113 |
| 8,166,776 | B2 | 5/2012 | Kopko et al. | |
| 9,551,532 | B2 | 1/2017 | Vouche et al. | |
| 9,951,994 | B2 | 4/2018 | Vouche | |
| 2002/0005176 | A1 | 1/2002 | Bensing et al. | |
| 2005/0161202 | A1 * | 7/2005 | Merkys | F28F 9/262 165/122 |
| 2008/0160902 | A1 | 7/2008 | Desler | |
| 2009/0165993 | A1 * | 7/2009 | Yang | F28F 13/06 165/47 |
| 2009/0211743 | A1 | 8/2009 | Schrader et al. | |
| 2009/0220334 | A1 | 9/2009 | Vouche | |
| 2010/0044010 | A1 | 2/2010 | Corser et al. | |
| 2010/0078147 | A1 | 4/2010 | Samyn et al. | |
| 2010/0132917 | A1 | 6/2010 | Runk et al. | |
| 2010/0147487 | A1 | 6/2010 | Lewandowski et al. | |
| 2010/0263840 | A1 | 10/2010 | Nobel | |
| 2011/0061845 | A1 * | 3/2011 | Wand | F28D 1/05383 165/173 |
| 2012/0023940 | A1 | 2/2012 | Kitz et al. | |
| 2012/0043061 | A1 * | 2/2012 | Blockerye | F28B 1/06 165/104.34 |
| 2014/0000863 | A1 * | 1/2014 | Bronicki | F24F 1/48 165/287 |
| 2014/0014292 | A1 * | 1/2014 | Rice | H05K 7/20745 165/11.1 |
| 2014/0150989 | A1 | 6/2014 | Eindhoven | |
| 2014/0367243 | A1 | 12/2014 | Kroger et al. | |
| 2015/0204611 | A1 | 7/2015 | Vouche et al. | |
| 2015/0330709 | A1 | 11/2015 | Vouche et al. | |
| 2015/0345166 | A1 * | 12/2015 | Quickelberghe | F01K 5/02 165/68 |
| 2016/0084520 | A1 * | 3/2016 | Fukui | F24F 1/00 62/519 |
| 2017/0363358 | A1 | 12/2017 | Bugler, III et al. | |

FOREIGN PATENT DOCUMENTS

| | | |
|---|---|---|
| CN | 101655322 | 2/2010 |
| EP | 0346848 | 12/1989 |
| GB | 908806 | 10/1962 |
| WO | 2010125017 | 11/2010 |

* cited by examiner

AIR-COOLED CONDENSER APPARATUS AND METHOD

RELATED APPLICATIONS

This patent arises from the U.S. national stage of International Patent Application Serial No. PCT/EP2017/062162, having an international filing date of May 19, 2017, and claims benefit of European Patent Application No. 16171343.3, filed on May 25, 2016, which are hereby incorporated by reference in their entireties for all purposes.

FIELD OF THE INVENTION

The invention is related to an air-cooled condenser apparatus for condensing a steam flow exiting a steam turbine of for example a power plant. More specifically, it relates to an air-cooled condenser comprising delta-type heat exchanger units. The invention also relates to a method for manufacturing, transporting and assembling an air-cooled condenser apparatus for condensing a steam flow from a turbine.

DESCRIPTION OF PRIOR ART

Various air-cooled condenser apparatuses for condensing steam from a power plant are known in the art. These air-cooled condensers make use of heat exchangers which generally comprise a number of tubes arranged in parallel so as to form a condenser panel, also named a tube bundle. The tubes of the condenser panel are in contact with the ambient air and a top duct feeds steam into the tubes. As the steam passes through the tubes, the steam gives off heat and is eventually condensed and collected with a steam/condensate manifold.

A specific category of air-cooled condenser apparatuses make use of a so called A-frame type or A-type or delta-type heat exchanger module. A delta type heat exchanger module comprises at least two condenser panels that are both placed in an inclined position with respect to a vertical axis that is perpendicular to a floor level. The two panels are separated by an opening angle δ which is typically between 400 and 600. Such an A-type condenser is for example discussed in U.S. Pat. No. 6,474,272B2. In view of the large amount of steam to condensate, large panels are needed and the tubes have a tube length that is typically between 9 and 12 m long. Those A-type or delta-type heat exchanger modules comprise a fan either located below the two condenser panels or located above the two condenser panels in order to either generate respectively a forced air draft or an induced air draft through the two panels. For each specific installation on a site, a number of heat exchanger modules are assembled and a support structure is designed to support the various number of A-type or delta-type heat exchangers needed in order to fulfill the steam condensation capacity requirements of a specific steam flow from a turbine.

A disadvantage of these air-cooled condenser apparatuses that make use of A-type or delta-type heat exchanger module is that there is a lot of time and labor consuming field welding to be performed on the site of installation. This is for example discussed in WO2013/158665 where a number of improved field welding techniques are disclosed. Indeed in view of the size, those delta-type heat exchangers are assembled on the site of installation. Each tube of the panel has to be connected to the top duct by field welding. In some methods, roof-shaped preassembly frames are used to preassemble some tubes to form a panel such as discussed in U.S. Pat. No. 8,191,259.

In EP2667133A2, an air-cooled condenser apparatus is disclosed where the condenser panels or bundles are prefabricated in a factory. On the installation site the two bundles are then erected and positioned at an inclination angle and then welded to a top duct.

Another disadvantage is that for each new installation on a site there is a lot of design and engineering work to be performed. Indeed, as there is a large variety of type of power plants, there are different requirements in terms of steam flow capacity to be handled. Hence, for each new installation at a site, generally, heat-exchanger modules need to be adapted and re-engineered and site specific support structures needed to be engineered and assembled.

SUMMARY OF THE INVENTION

It is an object of the present invention to to provide an air-cooled condenser apparatus wherein the re-engineering work from project to project is strongly reduced and wherein the design allows for a cost-efficient and labor efficient erection of the apparatus at the site of installation.

An additional objective of the present invention is to provide a method for manufacturing, transporting and assembling of an air-cooled condenser apparatus for condensing a steam flow from a turbine that is less dependent of the specific steam flow rate and wherein the process reduces the total cost and time to realize an air-cooled condenser project.

These objects and other aspects of the invention are achieved with the apparatus and method as claimed.

According to a first aspect of the invention, an air-cooled condenser apparatus for condensing a steam flow from a power plant is provided. Such an air-cooled condenser apparatus is erected along a vertical axis Z perpendicular to a floor level plane comprising two orthogonal axes X and Y perpendicular to the axis Z.

The air-cooled condenser apparatus according to the invention comprises a series of condenser modules ACCM (i) with i=1 to NMOD and 1≤NMOD. The number NMOD is the number of modules of the air-cooled condenser apparatus. An air-cooled condenser apparatus comprises multiple delta-type heat exchanger units, wherein each unit comprises a top duct, a first set of parallel tubes, a second set of parallel tubes, a first steam/condensate manifold and a second steam/condensate manifold. The tubes of the first and second set of parallel tubes comprise fins. The first set of parallel tubes is forming a first condenser panel and the second set of parallel tubes is forming a second condenser panel. The first and second set of parallel tubes are inclined with respect to the vertical axis Z and are positioned so as to have an opening angle δ between the first set and the second set of parallel finned tubes.

The top duct, the first steam/condensate manifold and the second steam/condensate manifold are extending in a direction parallel with the axis Y. The top duct is connected to an upper end of each tube of the first set of parallel tubes and connected to an upper end of each tube of the second set of parallel tubes. The first steam/condensate manifold is connected to a lower end of each tube of the first set of parallel tubes and the second steam/condensate manifold is connected to a lower end of each tube of the second set of parallel tubes.

Preferably, the first and a second set of parallel tubes are positioned so as to have an opening angle δ between the two sets of parallel tubes within a range 45°≤≤65.

The air-cooled condenser apparatus according to the invention is characterized in that that each condenser module ACCM(i) of the series of condenser modules comprises a series HEXU(j) of delta-type heat exchanger units with j=1 to UN, and with UN=2 or UN=3. The number UN is the number of heat exchanger units of the condenser module. The series HEXU(j) is forming a row of UN delta-type heat exchanger units extending along a direction parallel with the axis X. Each tube of the first and second set of parallel tubes has a tube length TL that is comprised in a range of 1.5 m<TL<2.5 m and the first steam/condensate manifold and the second steam/condensate manifold have a length PL that is comprised in a range of 8.0 m<PL<13.7 m.

The length PL of the first steam/condensate manifold and the second steam/condensate manifold is measured along a direction parallel with the Y axis, as illustrated on FIG. 1B, FIG. 11 and FIG. 12.

Each condenser module further comprises a series of fans FAN(k) with k=1 to FN and with 2≤FN≤4 and the fans FAN(k) are aligned along an axis parallel with the Y axis and configured to generate an air flow through each delta-type heat exchanger unit of the series HEXU(j). Preferably, the delta-type heat exchangers are self-supporting structures.

Advantageously, by aligning the fans FAN(k) along an axis such that an air flow is generated through each of the multiple delta-type heat exchanger units of the module, the number of fans per delta-type heat exchanger is reduced when compared to prior art air-cooled condensers. Indeed, in prior art delta-type heat exchanger configurations, each delta-type heat exchanger has its proper row of fans and hence one fan only blows air in one delta-type heat exchanger. In other words, for the module configuration according to the invention comprising two or three delta-type heat exchangers, there are a number of fans aligned along an axis so as to form a row of fans for generating an air flow in the two or three delta-type heat exchangers of the module. This module configuration reducing the number of fans results in a reduction of the fan power consumption per delta-type heat exchanger and it also facilitates the assembly of the modules at the site of installation.

The air-cooled condenser apparatus according to the invention further comprises a support structure. The support structure is configured for positioning the delta-type heat exchanger units at a height H1 equal or larger than 4 m above the floor level. The height is measured along the Z axis. The height H1 corresponds to the height where the steam/condensate manifolds rest on the frame structures.

In preferred embodiments, the support structure of the air-cooled condenser apparatus comprises a series of independent frame structures FRS(m) with m=1 to NFR configured for supporting a total number NTOT=UN×NMOD of delta-type heat exchanger units, and wherein the number NFR of independent frame structures is comprised in the range Ceiling(NMOD/3)≤NFR≤NMOD.

The function "Ceiling" is a function known in mathematics and computer science. The ceiling function maps a real number to the smallest following integer. More precisely, ceiling(x) equals an integer value that is the smallest integer greater than or equal to x. For example: ceiling(0.7)=1, ceiling(1.9)=2, ceiling(1.2)=2, ceiling(2.5)=3, ceiling(3)=3, ceiling (3.1)=4.

Advantageously, by limiting the tube length TL to be comprised in a range of 1.5 m<TL<2.5 m and the length PL of the first and second steam/condensate manifolds to be comprised in a range of 8 m<PL<13.7 m, the entire delta-type heat exchanger unit, fully assembled with the condenser panels and including the top duct and steam/condensate manifolds, can be placed in a standard container having a length of 12.2 m (40 foot) or a standard container having a length of 13.7 m (45 foot) and a container width of about 2.44 m (8 foot) and a height of 2.59 m (8 foot and 6 inches). In this way, the delta-type heat exchanger units according to the invention can, in a first step, be manufactured in a factory where the condenser panels are connected to the top duct and to the steam/condensate manifolds by shop welding and, in a second step, be transported with a standard container to the installation site.

Advantageously, by grouping 2 or 3 of these small standardized heat exchanger units and by placing a series of fans along an axis parallel with the axis Y, a compact standardized condenser module is formed and any air-cooled apparatus of various condensation capacity can be built by adding up a number of the standardized condenser modules according to the invention. A single delta-type heat exchanger unit according to the invention has a small exchange surface for condensing steam and building a module based on single delta-heat exchanger unit would result in too many modules and components needed to build an air-cooled condenser apparatus. Especially, the number of electrical fans would be too large.

Advantageously, as the condenser modules comprise a limited number of small heat exchanger units, the condensation capacity of one module is low. This has the advantage that by combining a multiple NMOD of condenser modules, any air-cooled condenser apparatus of a given capacity required can be built without the need to perform additional re-engineering calculations of the heat exchangers or modules.

Advantageously, the air-cooled condenser apparatus according to the invention can easily be reduced in condensation capacity by closing off one or more modules using for example an isolating valve for cutting off the steam supply to the delta-type heat exchangers of a condenser module. This can be important in winter time when capacity can be reduced to avoid damages to the tubes.

Advantageously, with the configuration of frame structures FRS(m) according to the invention, for a given number NMOD of condenser modules, the number of frame structures has a minimum value equal to Ceiling(NMOD/3). For example, for an air-cooled condenser apparatus according to the invention comprising seven condenser modules, the air-cooled condenser apparatus will have a minimum of Ceiling(7/3)=3 frame structures FRS(m). In another example, for twelve condensers, there will be a minimum of ceiling(12/3)=4 frame structures FRS(m). In this way, it is sufficient to design a number of smaller standard frame structures and to combine a number of these standard frame structures to support all the delta-type heat exchanger units.

Advantageously, by defining a minimum number of frame structures as function of the total number of condenser modules NMOD, as discussed above, no site specific calculations need to be performed for designing a frame support structure for a given steam supply from a turbine. In general, those frame structures are designed to be resistant against severe storms and earthquakes.

In embodiments, the series of independent frame structures FRS(m) comprises one or more frames of model A or one or more frames of model B or one or more frames of model C or any combination of a number of frames of model A, B or C, wherein frame model A is configured to support the delta-type heat exchanger units of one condenser module, frame model B is configured to support the delta-type heat exchanger units of two condenser modules and frame model C is configured to support the delta-type heat exchanger units of three condenser modules. With a combination of these standardized frame structures any total number of modules (NTOT=UN×NMOD) of a given air-cooled condenser apparatus can be supported.

Advantageously, the embodiments of the invention combine the advantages of having compact components that can be easily transported and reduce the installation time on site and at the same time a sizeable module with a sizeable condensation capacity is conceived by efficiently grouping components for defining a condenser module and for defining supporting structures.

In embodiments, an air-cooled condenser apparatus is provided wherein each condenser module ACCM(i) of the series of condenser modules comprises a box-shaped upper frame structure attached to the frame structures FRS(m) and wherein the box-shaped upper frame structure comprises means for attaching one or more panels so as to protect the delta-type heat exchangers from side winds or to avoid recirculating air between the delta type heat exchangers and the fans.

In preferred embodiments, the air-cooled condenser apparatus comprises a box-shaped upper frame comprising a fan deck located at height H2 with respect to the floor level and wherein H2≥7 m. This fan deck is configured to support the series of fans FAN(k) so as to induce, when in operation, an induced draft through the delta-type heat exchanger units.

In alternative embodiments, each independent frame structure of the series of independent frame structures FRS (m) comprises means for attaching one or more of the series of fans FAN(k) at a height H3 with respect to the floor level and wherein H3≥2 m, so as to generate, when in operation, a forced air draft through the delta-type heat exchanger units.

In preferred embodiments according to the invention, the first set of parallel tubes comprises a first group of primary tubes and a first group of secondary tubes and the second set of parallel tubes comprises a second group of primary tubes and a second group of secondary tubes. In these embodiments, the top duct comprises a first top duct section having an entrance opening on one end to receive steam and a cover on the other end, and wherein the first top duct section is connected to the first group of primary tubes and to the second group of primary tubes. The top duct further comprises a second top duct section comprising an exit opening for evacuating non-condensable gases and/or non-condensed steam and wherein the second top duct section is connected to the first group of secondary tubes and to the second group of secondary tubes. With this configuration, the primary tubes operate in a parallel flow mode where the steam and the condensate flow in the same direction, and the secondary tubes operate in a counter flow mode where the steam and condensate flow in an opposite direction. The first top duct section is also named steam manifold and the second top duct section is also named air take-off header.

In embodiments according to the invention, the top duct has an entrance opening for receiving steam that has a cross-sectional area S in the range of $0.12\ m^2 \leq S \leq 0.5\ m^2$.

In embodiments according to the invention, the number of condenser modules NMOD is equal or larger than two.

In embodiments according to the invention, a facility for condensing steam from a power plant comprises multiple air-cooled condenser apparatuses.

According to a second aspect of the invention, a method for manufacturing, transporting and assembling an air-cooled condenser apparatus is provided.

The method comprises a first step of manufacturing a plurality of delta-type heat exchanger units in a factory. For each delta-type heat exchanger, a top duct, a first steam/condensate manifold and a second steam/condensate manifold are provided. The first and second steam/condensate manifold have a length PL that is comprised within 8.0 m<PL<13.7 m. Preferably, the top duct also has a length between 8.0 m and 13.7 m. Further, a first and a second set of tubes are provided wherein each tube of the first and second set of tubes has a length TL that is comprised within a range 1.5 m<TL<2.5 m. Typically, the tubes of said first set and second set of tubes comprise fins.

The first step of the method comprises sub-steps of

- connecting a lower end of the first set of tubes to the first steam/condensate manifold, and an upper end of the first set of tubes to said top duct,
- connecting a lower end of the second set of tubes to the second steam/condensate manifold, and an upper end of the second set of tubes to the top duct, so as to form an opening angle δ between the first and second set of tubes wherein 45° 06565°.

The method further comprises a second step of transporting the plurality of manufactured delta-type heat exchanger units to an installation site where the air-cooled condenser apparatus is to be operated.

In a third step the air cooled condenser apparatus is assembled at the installation site, comprising the sub-steps of

- installing a support structure for supporting the plurality of delta-type heat exchanger units,
- forming one or more condenser modules by performing for each module the steps of
  - i) placing a number UN, with UN≥2, of the delta-type heat exchanger units on the support structure so as to form a row of UN adjacent delta-type heat exchanger units,
  - ii) installing a number of fans FN, with FN≥1, under or above the row of UN delta-type heat exchanger units.

Advantageously, by assembling a delta-type heat exchanger unit in the factory, including the attachment of the tubes to the top duct and to the steam/condensate manifolds, the time consuming on site field welding is avoided and the number of on-site crane manipulations is limited as the top duct, condenser panels and steam/condensate are lifted on the support frame by one single crane manipulation.

Advantageously, by manufacturing the delta-type heat exchanger unit as a self-supporting structure that can rest on the first and second steam/condensate manifolds, the units can be easily transported by having the units resting with their steam/condensate manifolds placed on a floor level of a transport carrier, such as a container. During the assembly on site, the entire self-supporting delta unit can be lifted with a crane and placed with the steam/condensate manifolds resting on the support structures. This strongly reduces the assembly work on site.

Advantageously, by providing a delta-type heat exchanger unit wherein the tube length and the length of the steam/condensate manifolds have specific constraints, a compact heat exchanger unit that unifies a top duct, a first set of tubes, a second set of tubes, a first steam/condensate manifold and a second steam/condensate manifold is obtained.

Advantageously, by forming a condenser module comprising a number of delta-type heat exchanger units in combination with a number of fans, a compact standardized condenser module is obtained and depending on the needs, a variety of different modules can be conceived using the same standardized base components.

In view of the small dimensions imposed on the delta-type heat exchanger, the condensation capacity of a single delta-type heat exchanger according to the invention is 5 to 7 times smaller when compared to a classical large scale A-type heat exchanger having a tube length of the order of 9 to 12 m and a combined panel length of about 14 m. As a result, the module according to the invention has a strong modularity capacity, i.e. by combining multiple condenser modules according to the invention it is possible to adequately adapt to any steam condensation capacity required, from a very small steam condensation capacity to a very large capacity requirement, without the need for customized design calculations.

Preferably, the first steam/condensate manifold and the second steam/condensate manifold are configured for supporting a weight resulting from the top duct, the first condenser panel and/or the second condenser panel such that the manufactured delta-type heat exchanger unit is a self-supporting structure that can rest on the first and second steam/condensate manifolds. In other words, the delta-type heat exchanger units are manufactured as self-supporting structures.

In embodiments according to the invention, the step of transporting comprises sub-steps of providing one container per delta-type heat exchanger unit to be transported, placing the delta-type heat exchanger unit to be transported in the container such that the delta-type heat exchanger rests with its first and second steam/condensate manifold on a floor level of the container or on a transportation support located on the floor level of the container.

In embodiments, a step of manufacturing frame structures of one or more models wherein each model is designed for supporting a given number of delta-type heat exchanger units, is provided.

In embodiments, the step of providing a top duct comprises an additional step of manufacturing the top duct with a first top duct section configured for operating a first section of the condenser panels in a parallel flow mode and manufacturing the top duct with a second section configured for operating a second section of the condenser panels in a counter flow mode.

Hence, with the top duct comprising this first and second section, each delta heat exchanger unit is to be interpreted as a standalone device capable of condensing a given steam flow and including the functionality of evacuating non-condensable gases.

In preferred embodiments, the step of forming a condenser module comprises the steps of providing a box-shaped upper frame structure comprising a fan deck, placing said box-shaped upper frame structure on top of said one or more frame structures, and wherein the step of installing on or more fans comprises the step of mounting the one or more fans on the fan deck.

In some embodiments, the step of manufacturing a plurality of delta-type heat exchanger units in a factory comprises a sub-step of attaching one or more strengthening elements 31 to the delta-type heat exchanger. Those strengthening beams avoid that the welding of the tubes to the top duct 2 would be damaged during transport or manipulations during the site installation.

According to a third aspect of the invention, a process of engineering and manufacturing an air-cooled condenser apparatus for condensing a steam flow from a power plant is provided as disclosed in the claims.

This process for engineering and manufacturing an air-cooled condenser apparatus for condensing a steam flow from a turbine comprises the following steps a) to h):

a) designing a delta-type heat exchanger unit comprising a top duct, a first condenser panel comprising a first set of parallel tubes, a second condenser panel comprising a second set of parallel tubes, a first steam/condensate manifold and a second steam/condensate manifold, wherein said delta-type heat exchanger unit is characterized in that a length TL of the tubes of said first and said second set of parallel tubes is within the range $1.5\ m<TL<2.5\ m$, an opening angle $\delta$ between the first and the second condenser panel is within the range $45°\leq\delta\leq65°$, a length PL of the first steam/condensate and second steam/condensate manifold is comprised in the range $8.0\ m<PL<13.7\ m$, b) designing a condenser module by grouping a number UN of said delta-type heat exchanger units (1) so as to form a series HEXU(j) of said delta-type heat exchanger units with j=1 to UN, and wherein UN is equal to 2 or 3, and wherein the delta-type heat exchanger units of said series HEXU(j) are positioned such that their top ducts are oriented in parallel so as to form UN rows of adjacent delta-type heat exchanger units, and defining a required number FN of fans FAN(k) with k=1 to FN and with $2\leq FN\leq4$, and wherein said required number of fans are aligned along an axis parallel with the direction of the top ducts of the grouped delta-type heat exchanger units HEXU(j) and wherein said required number of fans are configured to generate an air flow through the first and second condenser panel of each delta-type heat exchanger unit of said series HEXU(j), c) designing a first model of an independent frame structure for supporting all delta-type heat exchanger units of one condenser module and/or designing a second model of an independent frame structure for supporting all heat exchanger units of two condenser modules and/or designing a third model of an independent frame structure for supporting all heat exchanger units of three condenser modules, said first, second and third model of an independent frame structure are configured for positioning the delta-type heat exchanger units at a height H1 equal or larger than 4 m above a floor level, d) determining a required number NMOD of said condenser modules to condense said steam flow from said power plant, e) determining a required number of first model NMODA and/or a required number of second model NMODB and/or a required number of third model NMODC of independent frame structures for supporting said required number NMOD of condenser modules, f) assembling a number UTOT=UN×NMOD of said delta-type heat exchanger units in a factory comprising the sub-steps of attaching a first end of each tube of the first condenser panel to the top duct, attaching a second end of each tube of the first condenser panel to the first steam/condensate manifold, attaching a first end of each tube of the second condenser panel to the top duct, attaching a second end of each tube of the second condenser panel to the second steam/condensate manifold, g) providing UTOT of containers and placing each of the assembled delta-type heat exchanger units in a separate container for transportation to an installation site, h) erecting said air cooled condenser apparatus at said installation site, comprising the sub-steps of
positioning said required number NMODA of first model and/or required number NMODB of second model and/or required number NMODC of third model frame structures adjacent to each other,
positioning the delta-type heat exchanger units of each of said condenser modules on the first model and/or second model and/or third model of frame structures,
installing, for each condenser module, said required number FN of fans.

SHORT DESCRIPTION OF THE DRAWINGS

These and further aspects of the invention will be explained in greater detail by way of example and with reference to the accompanying drawings in which.

Figure 5A:
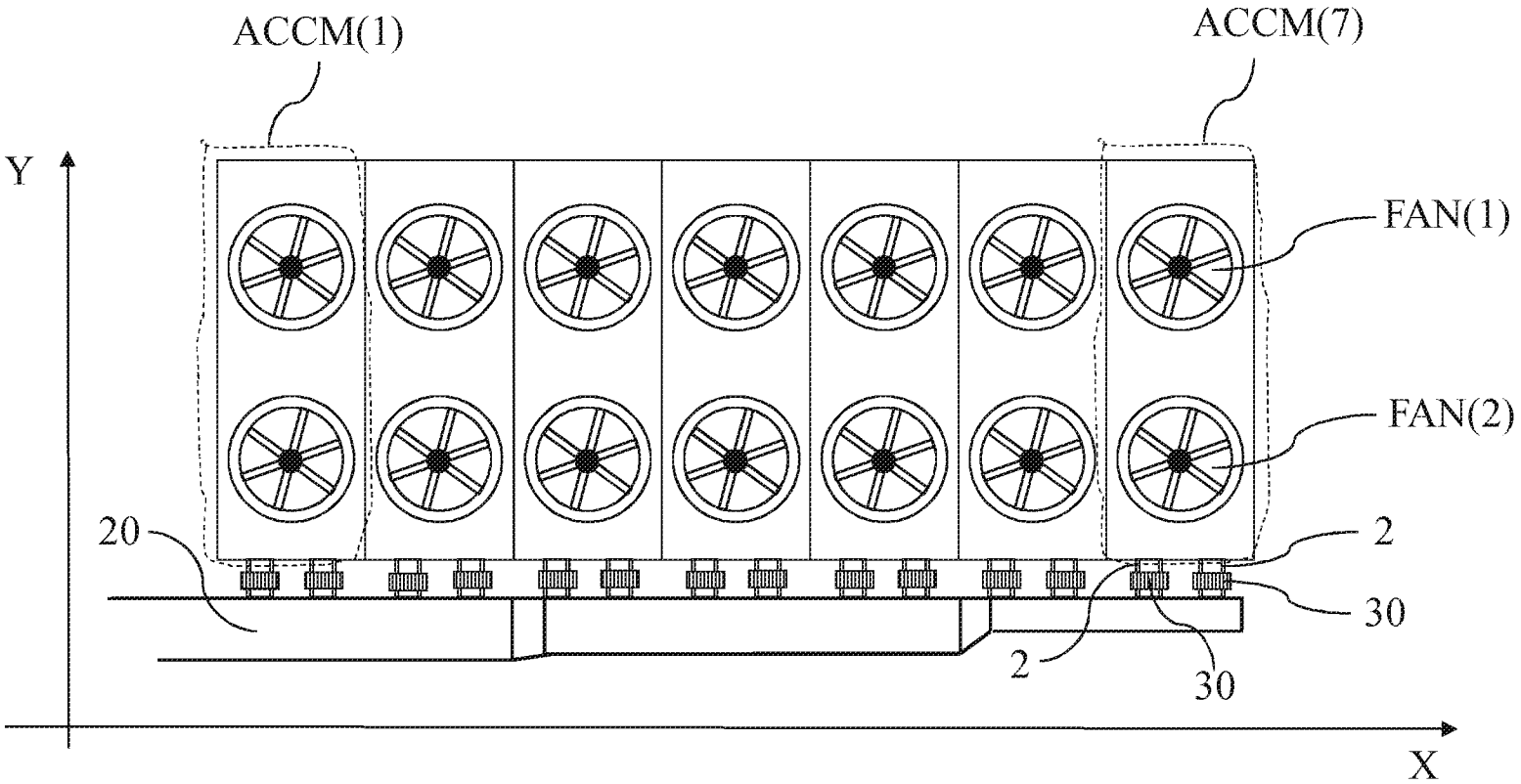
Figure 5B:
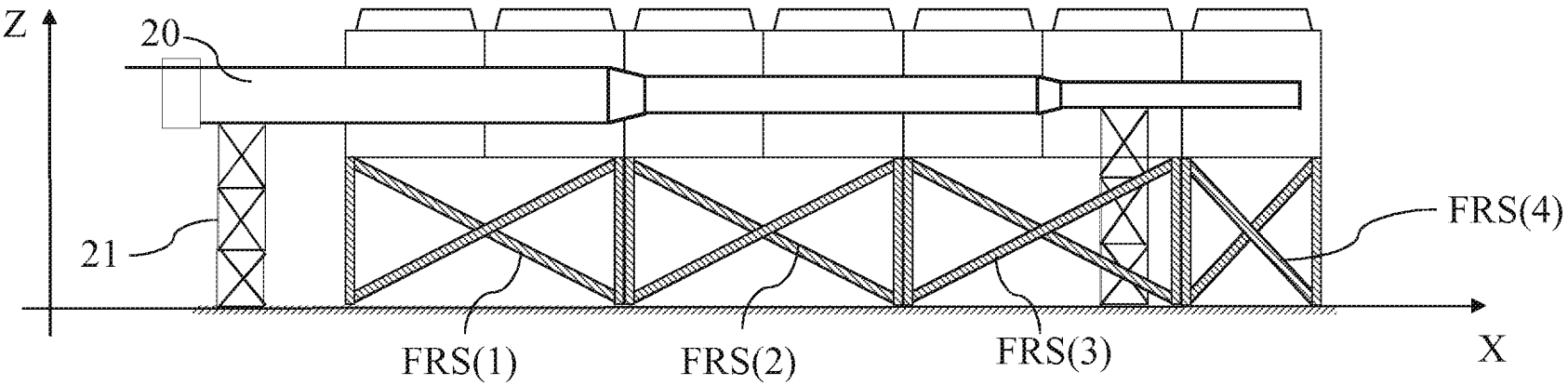

FIG. 5*a* shows a top view of an exemplary air-cooled condenser apparatus according to the invention, comprising seven condenser modules supported by four frame structures;

FIG. 5*b* shows a side view of the apparatus of FIG. 5*a;*

Figure 6:
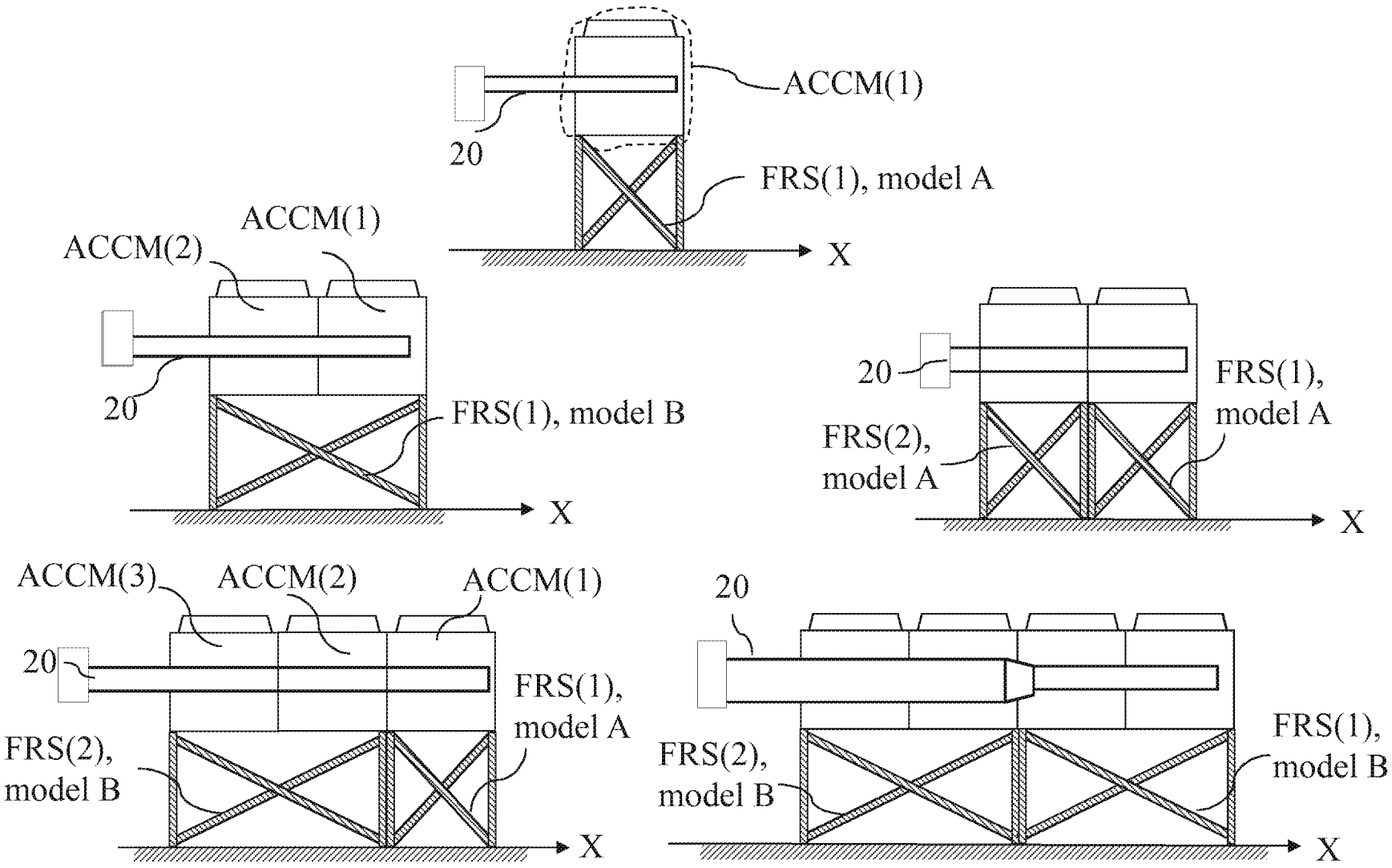
Figure 7:
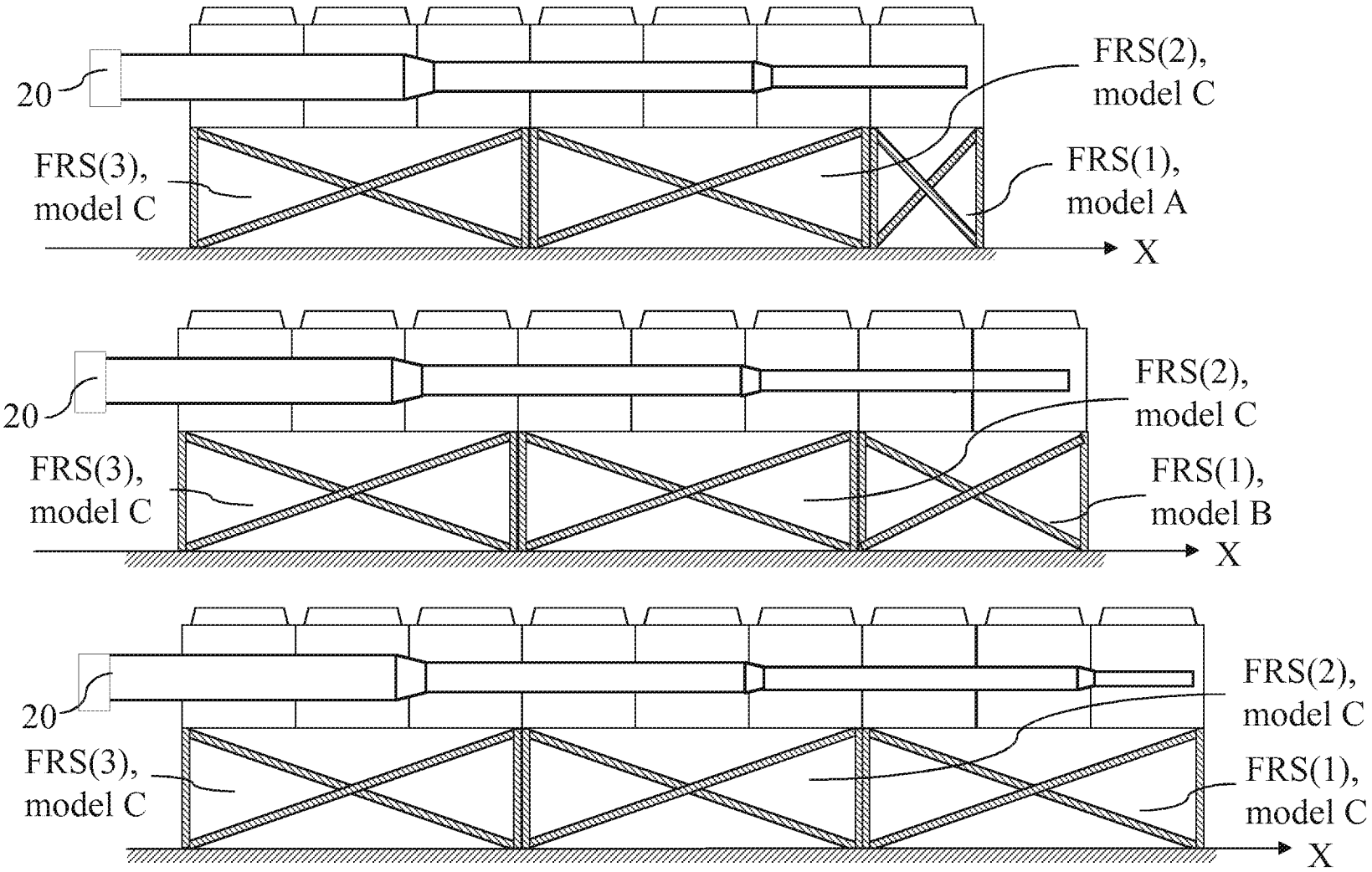
Figure 8:
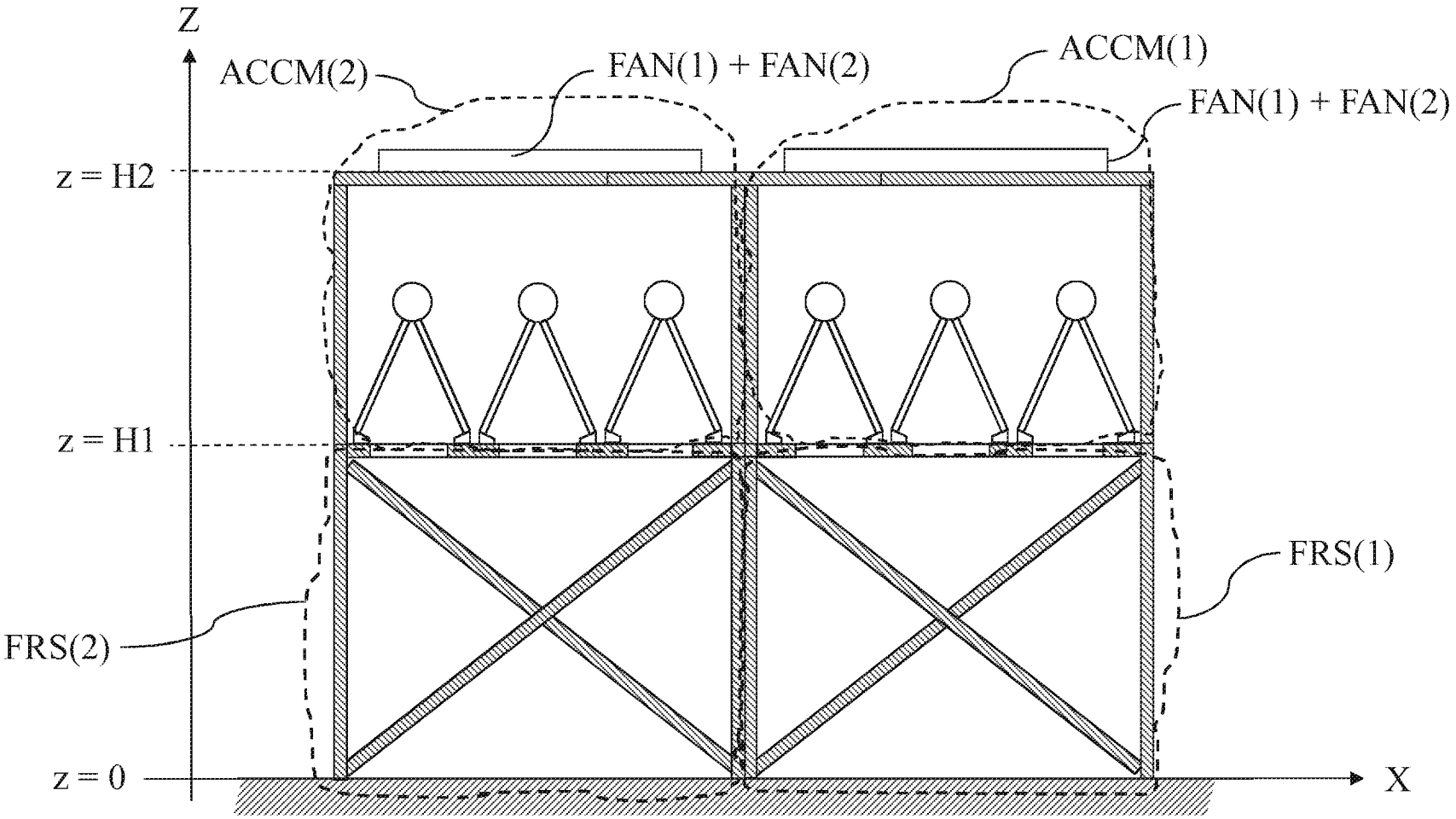
Figure 9A:
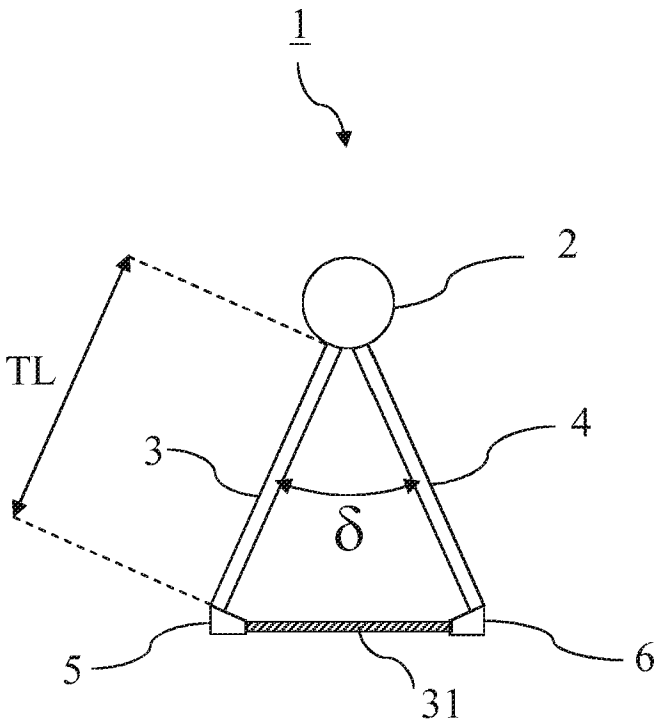
Figure 9B:
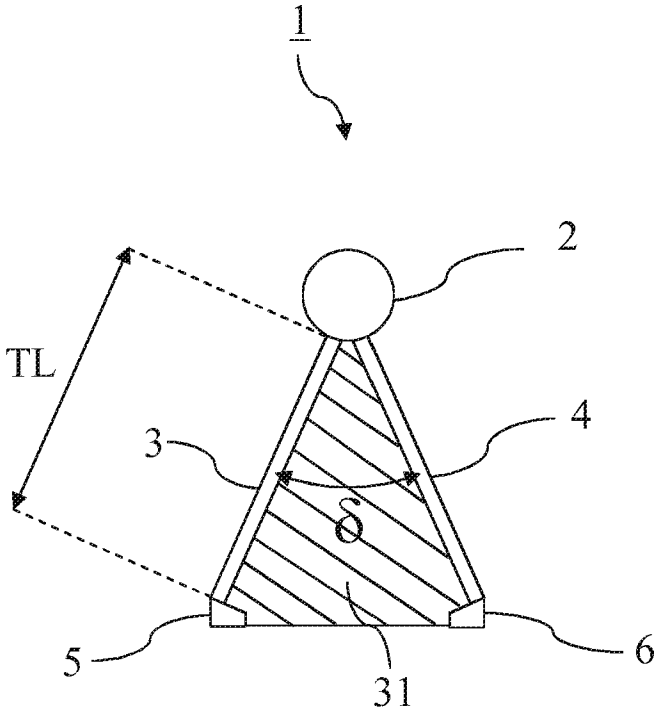
Figure 10:
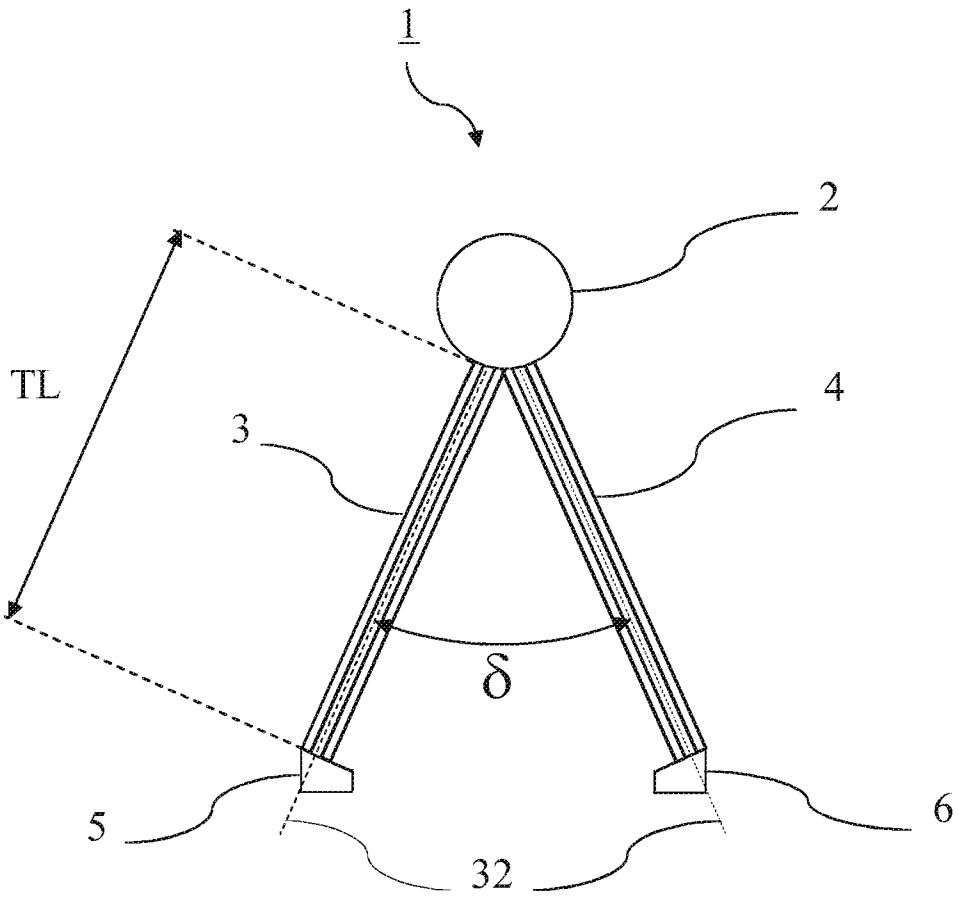

FIG. 6 shows side views of various examples of air-cooled condenser apparatuses according to the invention, comprising various numbers of modules and various numbers of frame structures;

FIG. 7 shows side views of other examples of air-cooled condenser apparatuses according to the invention comprising various numbers of modules and various numbers of frame structures;

FIG. 8 shows a cross section of an air-cooled condenser wherein each condenser module comprises three delta-type heat exchanger units;

FIG. 9A shows a delta-type heat exchanger unit comprising one or more strengthening beams;

FIG. 9B shows a delta-type heat exchanger unit comprising a cover plate;

FIG. 10 shows a schematic representation of a delta-type heat exchanger unit wherein the condenser panels are formed by three layers of tubes.

Figure 11:
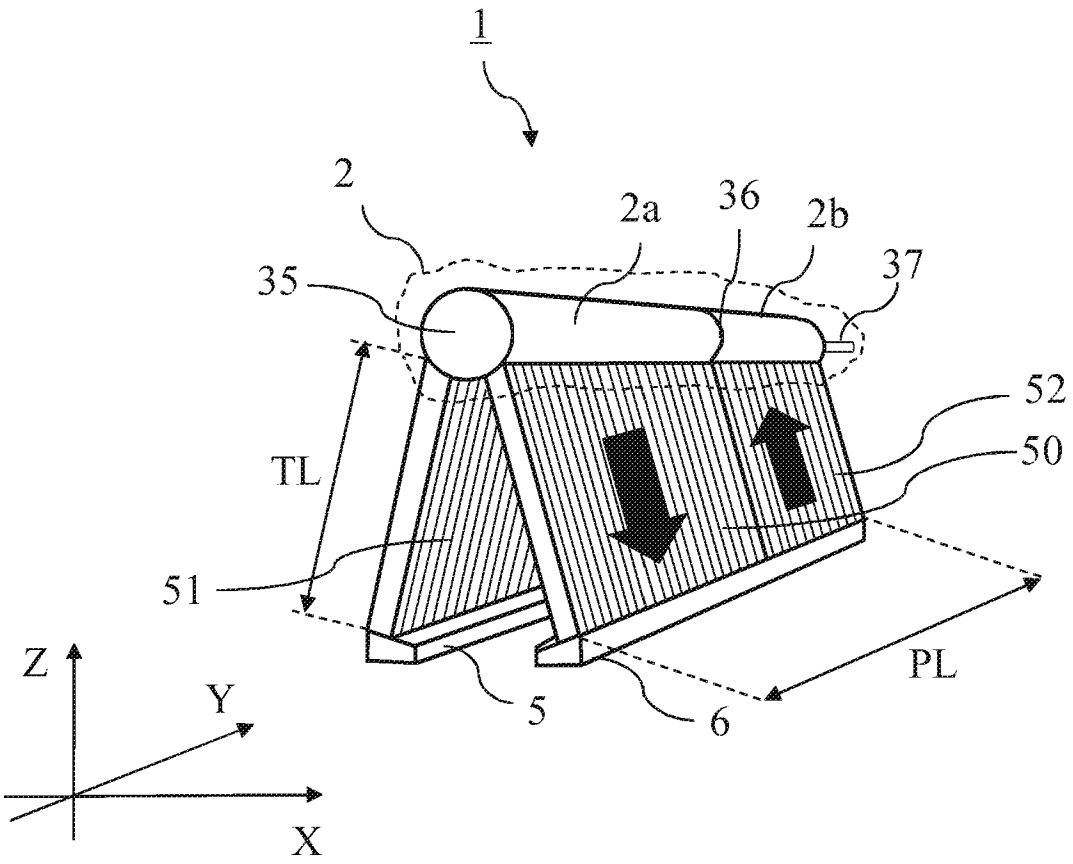
Figure 12:
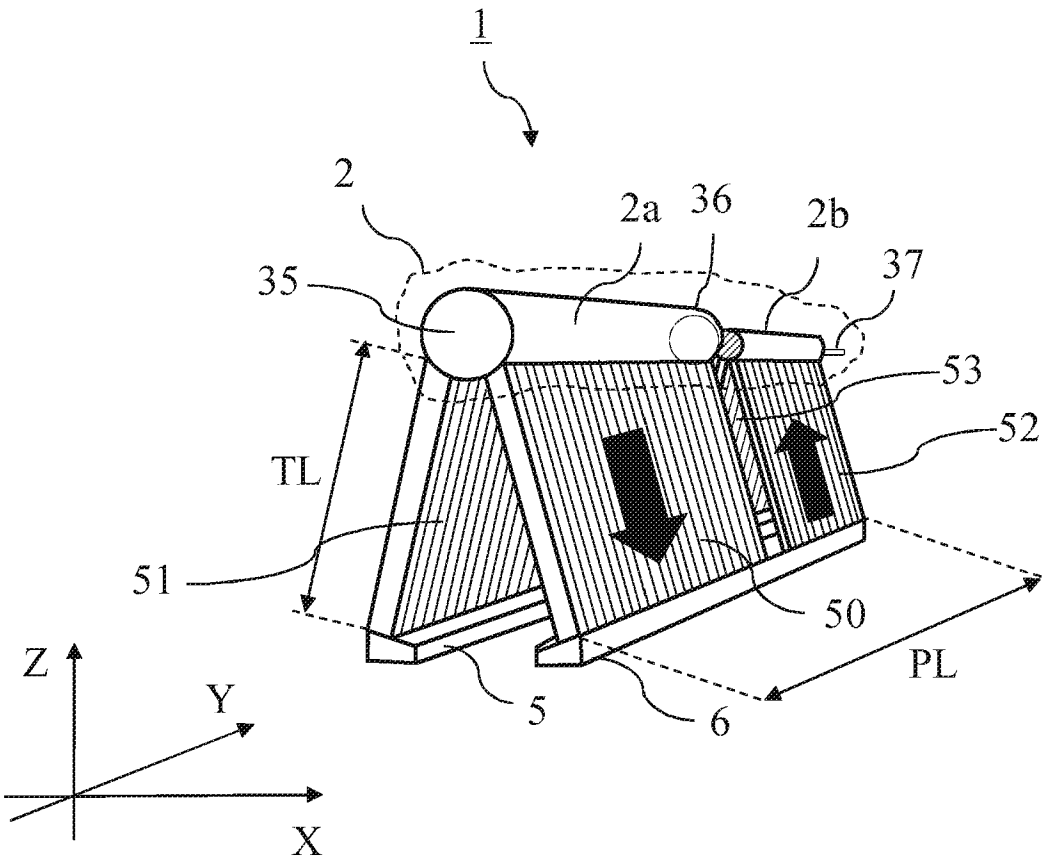

FIG. 11 shows a perspective view of a delta-type heat exchanger unit wherein the top duct comprises a first and a second section and wherein the condenser panels comprise primary and secondary tubes;

FIG. 12 shows a perspective view of a delta-type heat exchanger unit wherein a first manifold section is separated from a second manifold section.

The figures are not drawn to scale. Generally, identical components are denoted by the same reference numerals in the figures.

DETAILED DESCRIPTION OF PREFERRED EMBODIMENTS

The present invention has been described in terms of specific embodiments, which are illustrative of the invention and not to be construed as limiting. More generally, it will be appreciated by persons skilled in the art that the present invention is not limited by what has been particularly shown and/or described hereinabove. The invention resides in each and every novel characteristic feature and each and every combination of characteristic features. Reference numerals in the claims do not limit their protective scope. Use of the verbs "to comprise", "to include", "to be composed of", or any other variant, as well as their respective conjugations, does not exclude the presence of elements other than those stated. Use of the article "a", "an" or "the" preceding an element does not exclude the presence of a plurality of such elements.

According to a first aspect of the invention an air-cooled condenser apparatus for condensing a steam flow from a power plant is provided. Such an air-cooled condenser apparatus comprises a series of condenser modules ACCM (i) with i=1 to NMOD and 1≤NMOD. As shown on FIGS. 4 and 5, the air-cooled condenser apparatus is positioned on a floor level plane comprising two orthogonal axes X and Y and the apparatus is further erected in height along an axis Z perpendicular to the floor level. There is no limitation on the number of modules NMOD of the air-cooled condenser apparatus, NMOD can be any value ≥1. The number is defined by the amount of steam flow to be condensed. For example, a small air-cooled condenser apparatus can have 5 modules, other larger apparatuses can have 10 condenser modules, other can have 30 condenser modules or more. Generally, the number of modules NMOD is equal or larger than two.

Each condenser module according to the invention comprises a series HEXU(j) of so-called delta-type heat exchanger units (1) with j=2 to UN, and UN is equal to two or three. The series HEXU(j) is forming a row of UN delta-type heat exchanger units. This row is extending along a direction parallel with the axis X, as illustrated in FIGS. 2, 3,4 and 8. In other words, as shown on these figures, for each module, the delta-type heat exchangers are positioned adjacent to each other.

Figure 1A:
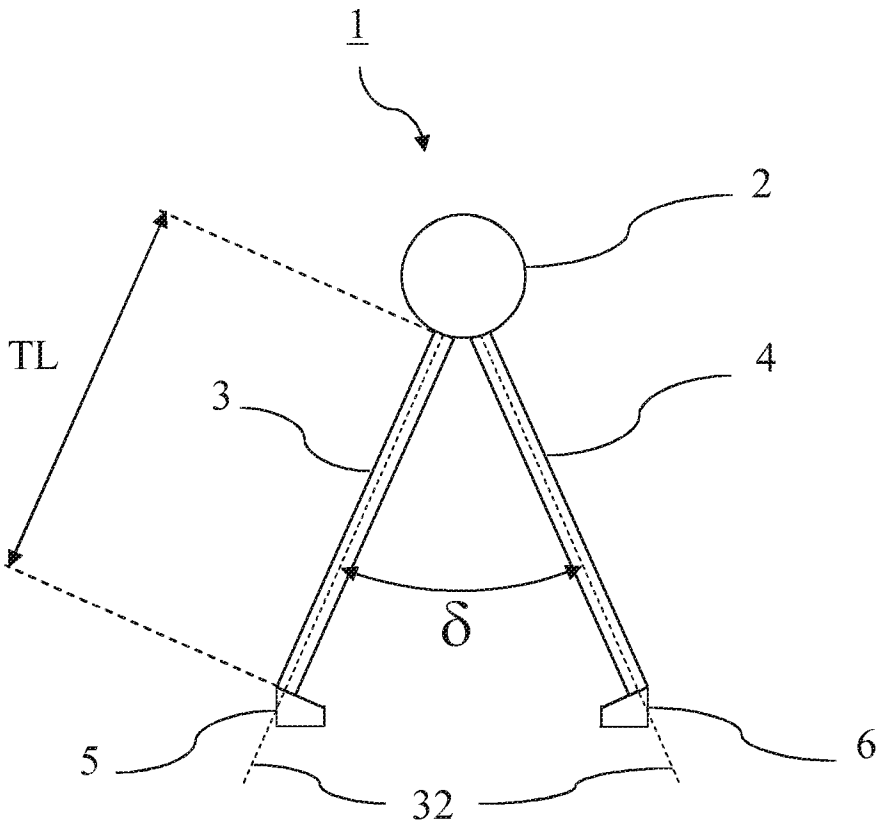
FIG. 1A shows a front view of a delta-type heat exchanger unit according to the invention.
Figure 1B:
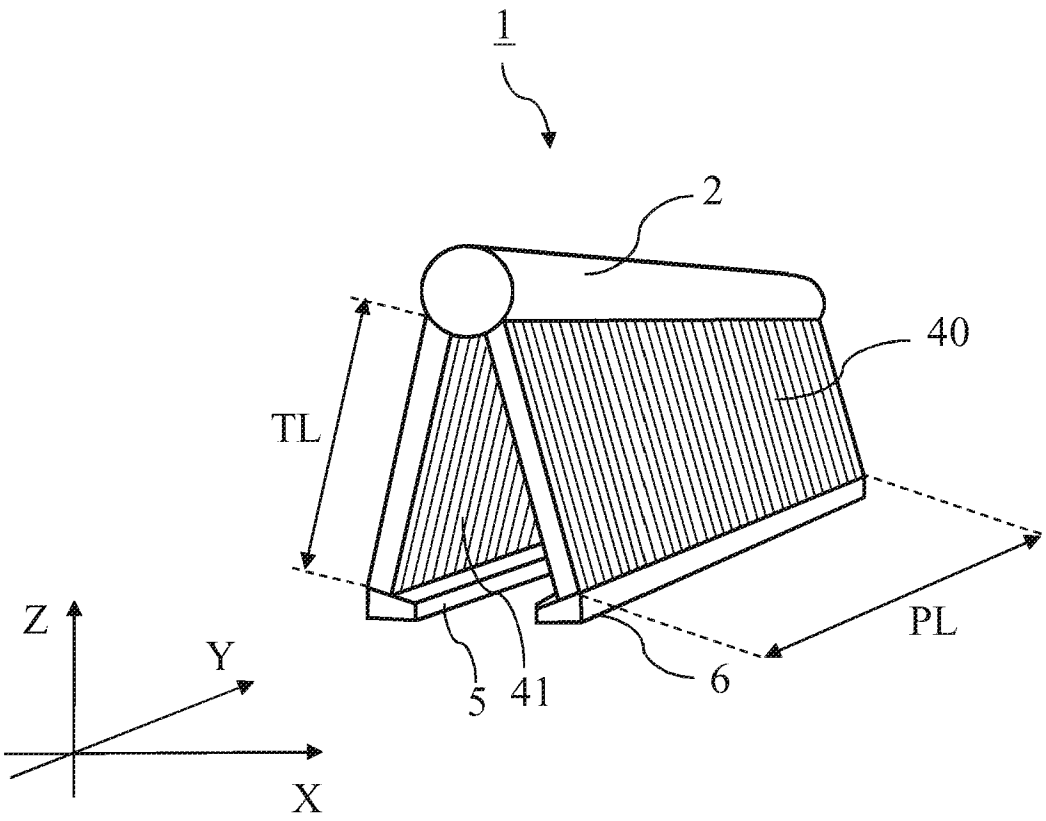
FIG. 1B shows a perspective view of the delta-type heat exchanger unit of FIG. 1A.
Figure 4:
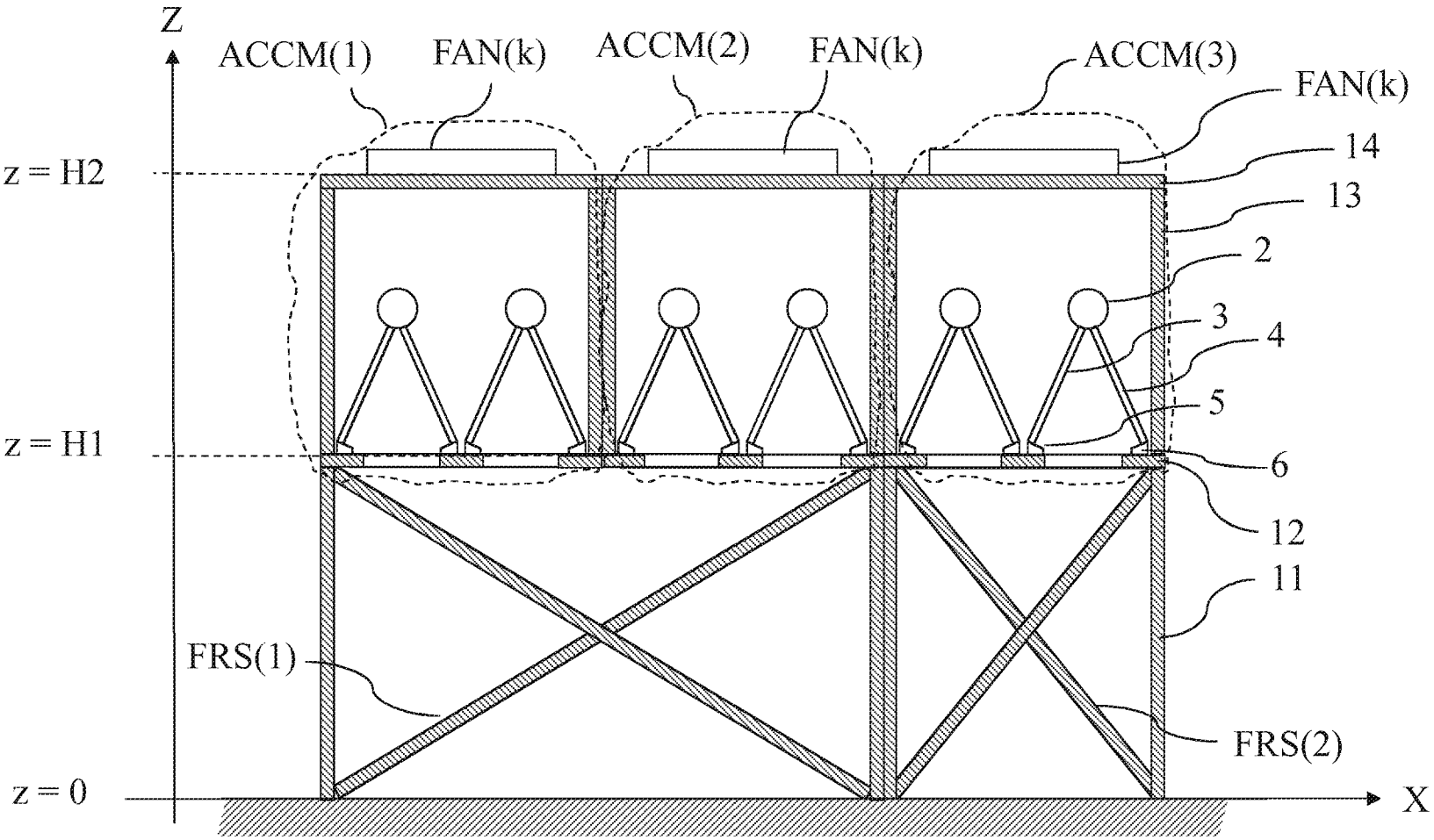
FIG. 4 shows a cross section of three condenser modules supported by two frame structures.

An example of a delta-type heat exchanger unit according to the invention is shown in more detail in FIG. 1A and FIG. 1B. Such a delta-type heat exchanger 1 comprises a top duct 2, a first 5 and a second 6 steam/condensate manifold extending in a direction parallel to the axis Y, a first set of parallel tubes 40 and a second set of parallel tubes 41 that are forming, respectively, a first condenser panel 3 and a second condenser panel 4. The tubes are schematically indicated on FIG. 1B. The first 40 and second 41 set of parallel tubes are inclined with respect to the vertical axis Z. As shown on FIG. 1B, the first and second steam/condensate manifold have a length PL along a direction parallel with the axis Y. In FIG. 4, an example of an air-cooled condenser apparatus is shown having three modules and wherein each module comprises two delta-type heat exchanger units.

The delta-type heat exchanger units of the air-cooled condenser according to the invention is characterized in that the tube length TL is comprised in a range of 1.5 m<TL<2.5 m and the length PL of the first and second steam/condensate manifold is comprised in a range of 8.0 m<PL<13.7 m. The length PL and the tube length TL are indicated on FIG. 1B.

The tube length TL has to be construed as the distance between the location where the upper end of the tube is connected to the top duct and the location where the lower end of the tube is connected to a steam/condensate manifold.

The length PL of the first and second steam/condensate manifold has to be construed as the distance of the steam/condensate manifold measured in a direction parallel with the Y axis as shown on FIG. 1B, this corresponds to the distance from the first tube to the last tube of the first set of parallel tubes or the distance from first to the last tube of the second set of parallel tubes. This typically corresponds to the distance between the locations where the first tube and the last tube of for example the first set of parallel tubes are connected to the first steam/condensate manifold. This length PL also corresponds to a panel length of the panel that is formed by the set of parallel tubes. Preferably, the length of the top duct 2 is also comprised in the range between 8.0 m and 13.7 m. In practice, as the parallel tubes are connected both to the top duct and to the steam/condensate manifolds, the length of the top duct and the length of the steam/condensate manifolds is the same or closely the same. In some embodiments, as shown on FIG. 5A, the length of the top duct can be slightly longer than the length of the steam/condensate manifolds in order to for example facilitate the installation of a bellow 30 on the entrance side of the top duct to be connected to the main steam duct 20. The main steam duct 20 is a duct elongated along an axis parallel with the axis X as shown on FIGS. 5A, 5B, 6 and 7.

Generally, the top duct 2 has a tubular shape. The delta-type heat exchanger units HEXU(j) of each condenser module are oriented such that their top ducts 2 are oriented in parallel so as to form a row of UN delta-type heat exchanger units. For example the single condenser module ACCM(1) shown in FIG. 2 comprises a row of two delta-type heat exchanger units wherein the two top ducts are oriented in parallel. Top ducts oriented in parallel has to be construed as an orientation wherein the central axes of the tubular top ducts are oriented in parallel. For example, as shown on FIG. 5A, the top ducts 2 of each of the seven modules are oriented in parallel with the Y axis. As shown on FIGS. 2 to 8, the rows of adjacent delta-type heat exchanger units are extending in a direction parallel with the axis X.

In embodiments according to the invention, the first set and a second set of parallel tubes are inclined with respect to the vertical axis Z so as to have an opening angle δ within a range $45° \leq \delta \leq 65\theta$. This opening angle δ is shown on FIG. 1A and FIG. 10. A delta-type heat exchanger with such an opening angle and dimensions as discussed above can enter the door opening of standard container (e.g. a door opening of 2.3 m).

The opening angle δ is measured as shown on FIG. 1A as the angle between two center planes 32 of the first condenser panel 3 and second condenser panel 4. The center planes 32 are shown as a dotted line on FIG. 1A and FIG. 10. In case the first condenser panel and the second condenser panel each comprise only one layer of parallel tubes (FIG. 1A), then the center plane 32 corresponds to a plane going through the center lines of the tubes of the panel. In case the first and second condenser panel are formed by multiple layers of parallel tubes, then the center plane is defined as the plane going through the center of the layers. This is schematically illustrated in FIG. 10 where, as an example, the first and second condenser panel comprise three layers of parallel tubes.

Each condenser module according to the invention comprises a series of fans FAN(k) with k=1 to FN and with $2 \leq FN \leq 4$, and wherein the fans FAN(k) are aligned along an axis parallel with the Y axis. An example of an air-cooled condenser apparatus comprising seven modules wherein each module comprises a series of fans FAN(k) having two fans, FAN(1) and FAN(2), that are oriented along a axis parallel with the Y axis is shown in FIG. 5A. The orientation of the fans along an axis parallel with the Y axis has to be construed as an orientation wherein the central rotation point of each of the fans lies on a line that is parallel with the Y axis.

A condenser module ACCM(i) according to the invention has to be construed as a configuration of a number UN of heat exchanger units HEXU(j) and a number FN of fans FAN(k). The modules are designed such that the fans FAN(k) provide the necessary air circulation through the UN number of heat exchanger units.

For example, in FIG. 5A and FIG. 5B, seven condenser modules are shown and each condenser module ACCM(i) comprises two heat exchanger units arranged in a row and each condenser module comprises two fans, FAN(1) and FAN(2), aligned along an axis parallel with the axis Y. In other words, in this example, the two fans FAN(1) and FAN(2) are forming a single row of fans for providing an air flow through the two delta-type heat exchangers of the module.

In FIG. 8, an example is shown of an air-cooled condenser apparatus comprising two modules, ACCM(1) and ACCM(2), wherein each module comprises three delta-type heat exchanger units. Each of the two modules shown on FIG. 8 comprises two fans, FAN(1) and FAN(2), forming a single row of fans aligned along an axis and configured to generate an air flow through the three delta-type heat exchangers of the module. In other words, in the embodiments according to the invention, for each module ACCM(i) comprising a series of delta-type heat exchanger units HEXU(j) with j=1 to UN, a row of fans FAN(k) with k=1 to FN is provided to generate an air flow through each of delta-type heat exchangers of the module.

Figure 2:
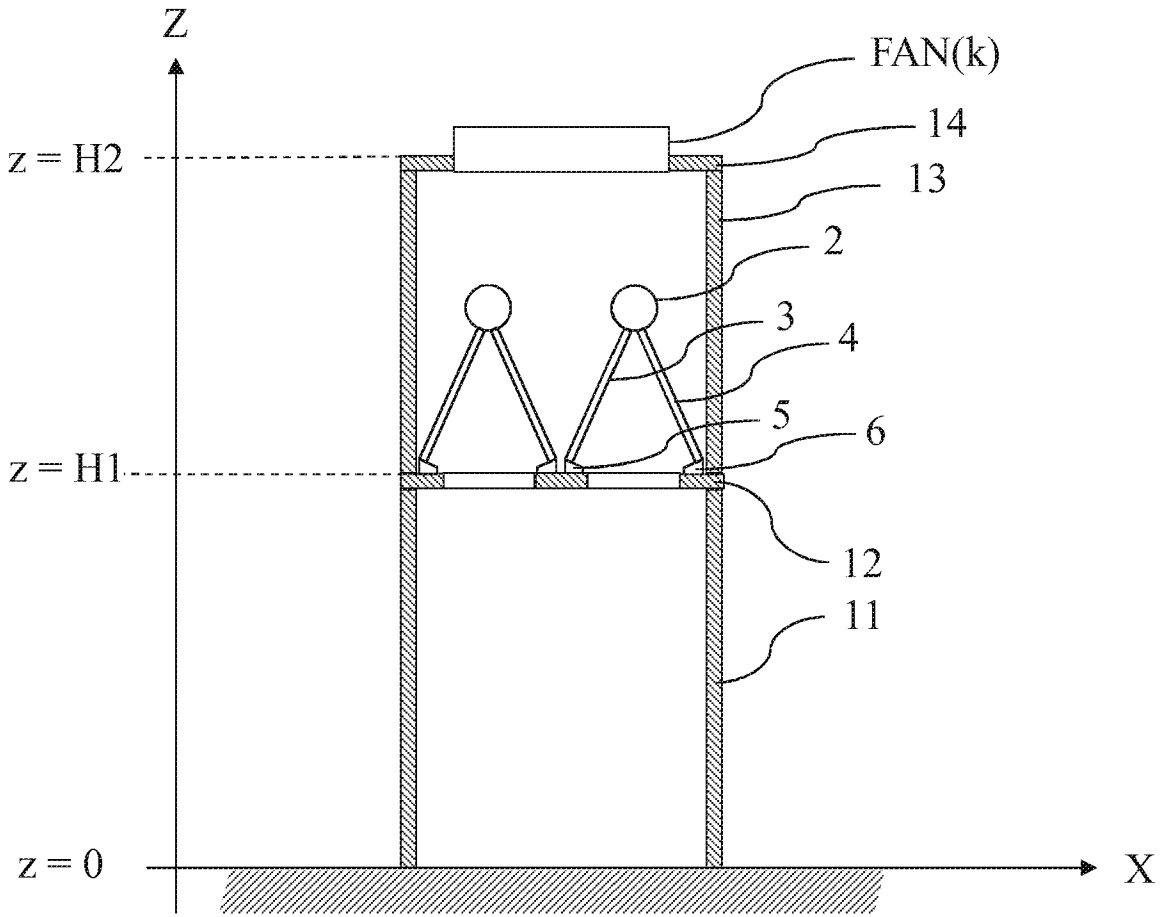
FIG. 2 shows a cross section of a single condenser module according to the invention, supported by one frame structure.
Figure 3:
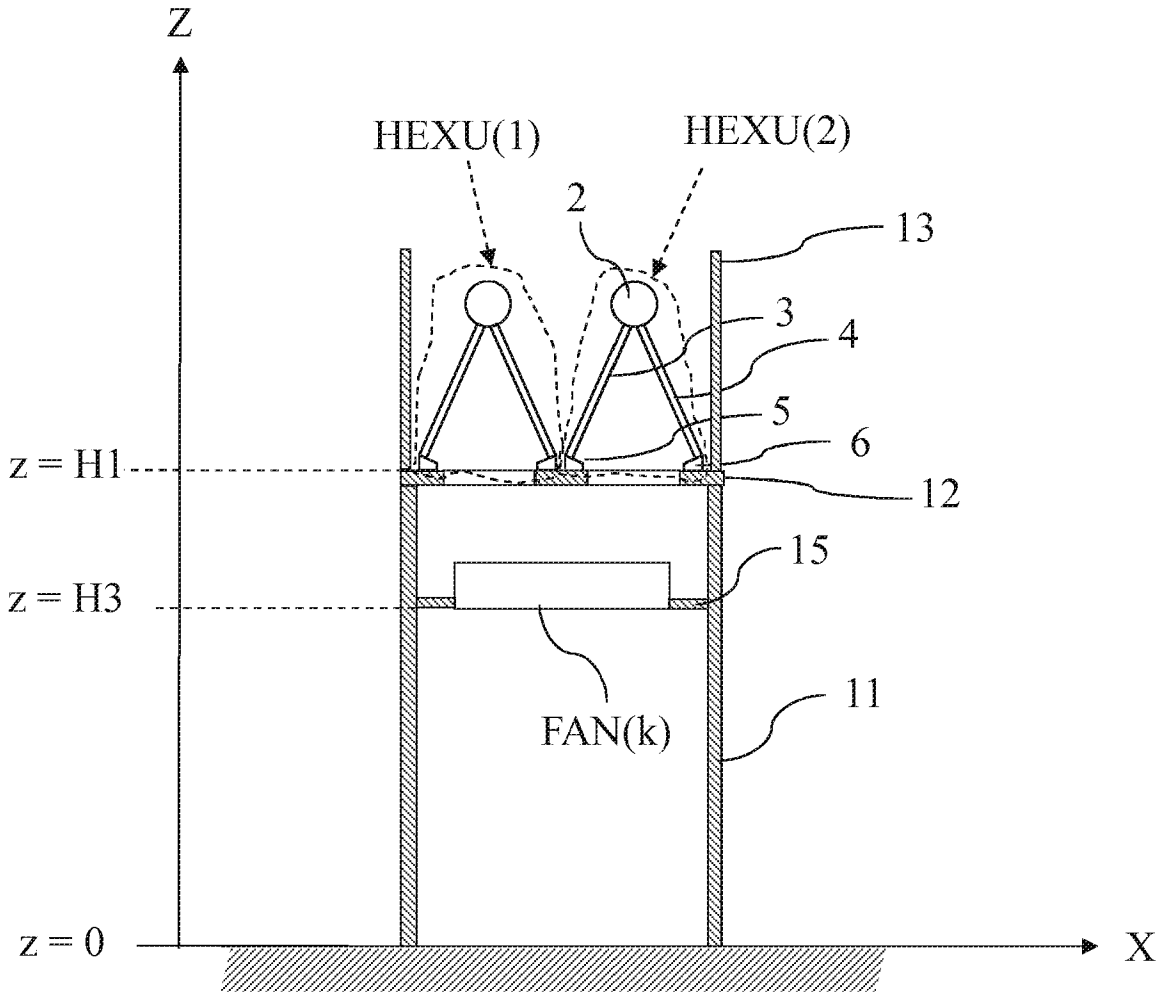
FIG. 3 shows a cross section of another single condenser module according to the invention, supported by one frame structure.

The heat exchanger units are supported by independent frame structures FRS(m). Typically, as shown on FIG. 2 and FIG. 3, the heat exchanger units have to be positioned at a height H1 from a floor level. In FIG. 2 and FIG. 3 the floor level is parallel with the axis X and Y and the height is defined with respect to the floor level and measured along the axis Z. Typically, to allow sufficient air supply and air circulation, the heat exchanger units are to be installed at a height H1 between 4 and 8 m from the floor level. As shown on FIG. 2 and FIG. 3, delta-type heat exchanger units rest with their steam/condensate manifolds on the independent frame structures. Hence, the height H1 corresponds to the height where the steam/condensate manifolds rest on the independent frame structures.

In embodiments, as shown for example on FIG. 2 and FIG. 3, the frame structures FRS(s) comprise supporting beams 12 positioned horizontally at a height H1>4 m with respect to the floor level. Supporting legs 11 are attached to the supporting beams 12 for holding the supporting beams at the height H1. The delta-type heat exchangers rest with their first 5 and second 6 steam/condensate manifolds on the supporting beams 12.

The air-cooled condenser apparatus according to the invention comprises a series of independent frame structures FRS(m) with m=1 to NFR configured for supporting the total number NTOT=UN×NMOD of delta-type heat exchanger units (1). Those frame structures position the heat exchangers at a height H1>4 m with respect to the floor level. The number of frame structures NFR according to the invention has a lower limit and an upper limit, defined as $\text{Ceiling}(NMOD/3) \leq NFR \leq NMOD$. The ceiling function has been discussed above.

An independent frame structure according to the invention has to be constructed as a frame structure that is self-standing or self-resting on the floor level, i.e. it comprises resting means such as legs that can be attached to the floor level.

By defining a lower limit for the number of frame structures, a number of standard frame structures can be designed that can used for all air-cooled condenser apparatuses according to the invention. Examples of standard type frame structures are a model A, a model B and model C wherein model A is configured to support the heat exchangers of one module, model B is configured to support the heat exchangers of two modules and model C is configured to support the heat exchangers of three modules. One can develop either only one model i.e. model A or one can develop model A and model B or one can develop the three models A,B,C. Hence, due to the definition of the number of frames FRS(m), only one or two or three standard frame structures need to be designed to support any total number NTOT=UN×NMOD of heat exchanger units.

In table 1, the number of frames structures NFR according to the invention is given for a number of configurations of air-cooled condenser apparatuses having a different number of condenser modules (NMOD). In the second column, the number of NFR of frames according to the invention is given and, in between brackets, a few examples of favorable frame combinations with standard frames A, B or C are given. If the air-cooled condenser apparatuses are rather small and require less than 5 modules, only needs a single frame structure model A is to be designed. For five or more modules, it is practically better to design two type of frames structures, model A and model B. As shown in table 1, with for example two standard frame structures A and B, an air-cooled condenser apparatuses with up to 10 modules can be built. For more than 10 modules, with two standard frames one can continue to find the combinations needed but for practical reasons, to reduce the total number of frame structures, an additional third model C is recommended if more than 10 modules need to be installed.

TABLE 1

Possible number of frames NFR for a given number NMOD of modules.

| #Modules NMOD | #Frame structures Ceiling(NMOD/3) ≤ NFR ≤ NMOD |
|---|---|
| 1 | 1 (1 × A) |
| 2 | 1 (1 × B) or 2 (2 × A) |
| 3 | 1 (1 × C) or 2 (1 × A + 2 × B) or 3 (3 × A) |
| 4 | 2 (2 × B) or 3 (2 × A + 1 × B) or 4 (4 × A) |
| 5 | 2 (1 × B + 1 × C) or 3 (2 × B + 1 × A) or 4 or 5 |
| 6 | 2 (2 × C) or 3 (3 × B) or 4 or 5 or 6 |
| 7 | 3 (2 × C + 1 × A) or 4 (3 × B + 1 × A)) or 5 or 6 or 7 |
| 8 | 3 (2 × C + 1 × B) or 4 (4 × B) or 5 or 6 or 7 or 8 |
| 9 | 3 (3 × C) or 4 (4 × B + 1 × A) or 5 or 6 or 7 or 8 or 9 |
| 10 | 4 (3 × C + 1 × A) or 5 (5 × B) or 6 or 7 or 8 or 9 or 10 |

The frame structures FRS(m) are typically open frame steel structures comprising beams.

In FIG. 6 and FIG. 7 show a number of configurations of air-cooled apparatuses according to the invention. These apparatuses comprise modules having two delta-type condenser units and the condensation capacity of the apparatus is increased by adding more condenser modules. Support structures FRS(i) as discussed above are provided to support the total number of delta-type heat exchangers. In FIG. 6, five examples are shown of configurations that comprise support structures of the model A and/or B. In FIG. 7, three examples of configurations comprising one or more support structures of model C are shown. The top panel shows seven modules supported by three frame structures, two of model C and one of model A. The middle panel of FIG. 7 shows eight modules supported by three frame structures, two of model C and one of model B. The lower panel shows nine condenser modules supported by three support structures of model C. In FIG. 8, an example of an apparatus comprising two modules wherein each module comprises three delta-type heat exchangers is shown. In this example, the two modules are supported by two independent frame structures of model A.

As discussed above, the first 3 and a second 4 condenser panels comprise parallel tubes having a tube length TL. As known in the art, a condenser panel, also named tube bundle, comprises either a single row of tubes or multiple rows of tubes. The tubes preferably comprise fins to improve the heat exchange.

In an embodiment according to the invention, current state of the art single row tubes are used for manufacturing the condenser panels. The cross sections of these single layer tubes can have for example a rectangular shape or alternatively an elliptical shape. In other embodiments, multiple layer round core tubes can be placed in parallel for forming the tube bundles or condenser panels.

An exemplary embodiment of an air-cooled condenser apparatus according to the invention is shown on FIG. 5A and FIG. 5B. This exemplary air cooled condenser apparatus according to the invention comprises seven condenser modules and has the same steam condensation capacity as two prior art large scale A type condenser apparatuses. In this example shown on FIG. 5A and FIG. 5B, each condenser module comprises two delta heat exchanger units and two fans aligned along an axis parallel with the direction of the two top ducts of the two delta heat exchanger units. The first 6 modules are supported by three support structure of the second model supporting two modules and the last module is supported by a support structure of the first model supporting one module.

The footprint (lengths along the X and Y axes) of the 7 modules according to the invention is about the same as the two-module prior art A-type condenser apparatus. The total exchange surface is also about the same, reflecting that the condensation capacity of the 7 modules according to the invention is equivalent to two A-type modules.

In embodiments according to the invention, the delta-type heat exchanger unit (1) comprises a top duct 2 with a circular entrance opening for receiving steam. Typically the circular entrance opening has an inner diameter $\phi$ in the range 0.4 m<$\phi$<0.8 m. In other embodiments, the opening of the top duct can have any other geometrical shape such as for example an elliptical entrance opening. In general, at the entrance opening, the top duct has a cross-sectional area S in the range of 0.12 $m^2 \leq S \leq 0.5$ $m^2$. In some other embodiments, the top duct can have a conical shape.

In embodiments, a bellow 30 is attached to each top duct 2 of each delta-type heat exchanger unit as illustrated in FIG. 5A. This bellow allows for a flexible connection of the top duct with the main steam duct 20. Typically, the main steam duct 20 that brings steam from for example a turbine to the air-cooled condenser apparatus is supported by a main steam duct support 21 as shown on FIG. 5B.

According to embodiments of the invention, as shown in FIG. 2 to 4, each condenser module ACCM(i) of the series of condenser modules comprises a box-shaped upper frame structure 13 attached to the independent frame structures FRS(m). This box-shaped upper frame structure comprises means for attaching one or more panels so as to protect the delta-type heat exchangers from side winds or to avoid recirculating air between the delta type heat exchangers and the fans.

In a preferred embodiment, an air-cooled condenser apparatus of the induced draft type is provided as shown in FIG. 2, FIG. 4 and FIG. 5A wherein, for each module, the series of fans FAN(k) is installed above the delta-type heat exchanger units of the module. In these embodiments, each condenser module ACCM(i) of the series of condenser modules comprises a box-shaped upper frame 13 comprising a fan deck 14 located at height H2 with respect to the floor level and wherein H2−H1>2.5 m. This fan deck is configured to support the series of fans FAN(k) so as to induce, when in operation, an induced draft through the delta-type heat exchanger units of a condenser module. By keeping the difference H2−H1>2.5 m, a plenum is created between the top duct and the fans. In practice, H2 is larger than 7 m.

In other embodiments, an air-cooled condenser apparatus of the forced draft type is provided as shown in FIG. 3 where, for each module, the series of fans FAN(k) is installed below the delta-type heat exchangers. In these embodiments, each independent frame structure of the series of independent frame structures FRS(m) comprises means for attaching one or more of the series of fans FAN(k). This means for attaching is for example a fan support 15 as shown in FIG. 3 that is attached to for example to the supporting legs 11 of the independent frame structure FRS(m). Typically, the fans of the series of fans FAN(k) are attached 0.5 m to 2 m below the level where the delta-type heat exchangers are positioned. In this way a plenum is created between the fans and the delta-type heat exchangers. Therefore, the frame structures FRS(m) used for a forced type of air-cooled condenser have a height that is 0.5 m to 2 m higher than the frame structures that are used for systems that use induced draft where the fans are on top of the delta-type heat exchangers. In practice, for these embodiments, the fans of the series of fans FAN(k) are positioned at a height H3 larger than 2 m above the floor level.

In preferred embodiments according to the invention, as illustrated in FIG. 11 and FIG. 12, the top duct 2 of each of the delta-type heat exchanger units of each module comprises a first top duct section 2*a* and a second top duct section 2*b*. This first top duct section 2*a* can also be named steam manifold and the second top duct section can also be named air take-off header. In these preferred embodiments, the first set 40 and the second set 41 of parallel tubes comprise primary tubes 50,51 and secondary tubes 52,53 and the primary tubes are connected to the first top duct section and the secondary tubes are connected to the second top duct section. In this way, the primary tubes connected to the first top duct section 2*a* are configured for operating in a parallel flow mode wherein the steam and the condensate flow in the same direction. The secondary tubes connected to the second top duct section 2*b* are configured for operating in a counter flow mode wherein the steam flows in the opposite direction of the flow of the condensate flow. The second top duct section 2*b* allows for evacuating non-condensable gases and/or non-condensed steam. In FIG. 11 and FIG. 12, the large black arrows shown on the first panel section formed by primary tubes 50 and the second panel section formed by secondary tubes 52 indicate, when in operation, the direction of the steam flow through the primary 50 and secondary tubes 52.

The first panel section formed by the primary tubes and the second panel section formed by the secondary tubes can either be adjacent panels as shown on FIG. 10, or the two panel sections can slightly be separated in space as illustrated in FIG. 11. The advantage of leaving some spacing between the first section and the second section of the panels is to allow for some expansion of the panel sections due to the temperature of the fluid in the tubes. This expansion is different in the first section of the panel and second section of the panel as the temperature of the fluid in the primary and secondary tubes is different.

In embodiments, as shown on FIG. 11, the first manifold section 2*a* has a tubular shape with an entrance opening 35 on one end to receive steam and a cover 36 on the other end of the first manifold section, and the second manifold section 2*b* comprises an exit opening 37 for evacuating non-condensable gases and/or non-condensed steam.

Delta-type heat exchanger units comprising condenser panels having primary and secondary tubes as discussed above are known in the art. When in operation, steam from the turbine enters the entrance opening 35 of the first top duct section 2*a* and then goes through the primary tubes where the steam is condensed. Non-condensable gases and/or remaining steam that is not condensed in the primary tubes enters via the steam/condensate manifolds in the secondary tubes. The remaining steam can be further condensed in the secondary tubes in a counter flow mode, discussed above. The non-condensable gases that arrive in the second section 2B of the top duct 2 are then evacuated through the exit opening 37, typically using a pump.

As known in the art, the first top duct section 2*a* and the second top duct section 2*b* have to be construed as two distinct manifolds, i.e. there is no direct fluid connection between the two sections. The only fluid connection between the two manifold sections is an indirect connection via the primary tubes, followed by the steam/condensate manifold and finally the secondary tubes. In embodiments, the diameter of the second top duct section 2*b* can be smaller than the diameter of the first top duct section 2*a* as illustrated on FIG. 12.

According to a second aspect of the invention, a method for manufacturing, transporting and assembling an air-cooled condenser apparatus is provided.

In a first step a) a plurality of delta-type heat exchanger units 1 are manufactured in a factory. Each delta-type heat exchanger unit 1 comprises a top duct 2, a first set and a second set of tubes and a first and second steam/condensate manifold. The first 5 and second 6 steam/condensate manifold have a length PL that is comprised in the range 8.0 m<PL<13.7 m and the tube length of the tubes is comprised in the range 1.5 m<TL<2.5 m. The opening angle δ between the first set and second set of tubes is within the range 45°≤δ≤65°.

Preferably, the top duct 2 also has a length between 8.0 m and 13.7 m. As discussed above, the top duct 2 can comprise a first section and a second section and the total length of the top duct is determined by the length of the first and second top duct section.

During this manufacturing step in the factory, an upper end of the first set of tubes is connected to the top duct 2 and a lower end of the first set of tubes is connected to a first steam/condensate manifold. And similar, an upper end of the second set of tubes is connected to the top duct and a lower end of the second set of tubes is connected to a second steam/condensate manifold. In this way, a fully assembled delta-type heat exchanger unit is obtained in the factory and can be further transported to a site of installation as one assembled unit.

In a step b), the plurality of manufactured delta-type heat exchanger units are transported to an installation site where the air-cooled condenser apparatus is to be operated. In a preferred embodiment, each delta-type heat exchanger unit is placed in a separate container, i.e. there is one container per delta-type heat exchanger unit. Advantageously, each delta-type heat exchanger unit rests with its first and second steam/condensate manifold on a floor level of the container or on a transportation support located on the floor level of the container. The transport support is for example a frame that is used to protect the delta-type heat exchangers during transport or the transport support is a protecting packaging around the first and second steam/condensate manifold or the transportation support can comprise wheels to facilitate placing the delta-type heat exchanger unit in the container.

In a final step c), the air cooled condenser apparatus is assembled at the installation site. This step comprises the sub-step of placing a support structure configured to support the plurality of delta-type heat exchanger units. In a second sub-step, one or more condenser modules are formed by performing for each module the steps of positioning two or more delta-type heat exchanger units on the support structure so as to form a row of delta-type heat exchanger units, and by installing one or more fans configured to generate an air flow through the delta-type heat exchanger units of the module.

In some embodiments, as illustrated in FIG. 9A and FIG. 9B, the step of manufacturing a plurality of delta-type heat exchanger units 1 in a factory comprises a sub-step of attaching a strengthening element 31 to the delta-type heat exchanger unit.

Those strengthening elements 31 can either be removed during the installation phase on the site of installation or alternatively, those strengthening elements can be remained in place.

In embodiments, as shown on FIG. 9A, the strengthening element 31 comprises a strengthening beam attached with one end to the first steam/condensate manifold and attached with a second end to the second steam/condensate manifold.

In some embodiments, the step of assembling the air cooled condenser apparatus at the installation site, comprises a step of removing the one or more strengthening beams 31. Alternatively, the one or more strengthening beams are not removed during the assembling at the installation site.

In other embodiments, as illustrated in FIG. 9B, the strengthening element 31 comprises a covering plate having a triangular shape. By attaching two of these plates to the sides of the delta-type heat-exchanger, the sides are covered. When in operation, those covering plates prohibit the air to escape through the sides of the delta-type heat exchanger and force the air to go through the condenser panels 3,4. In some embodiments, the strengthening elements 31 comprise both, one or more strengthening beams and two cover plates to cover the sides of the delta-type heat-exchanger.

According to a third aspect of the invention a process to engineer and manufacture an air-cooled condenser apparatus for condensing a steam flow from a turbine is provided.

In a first step a) a delta-type heat exchanger unit 1 (HEXU) is designed. Such a delta-type heat exchanger unit comprises, as shown on FIGS. 1A,1B,10,11 and 12, a top duct 2, a first condenser panel 3 comprising a first set of parallel tubes, a second condenser panel 4 comprising a second set of parallel tubes, a first steam/condensate manifold 5 and a second steam/condensate manifold 6. The HEXU is characterized in that the length TL of the tubes of both the first set and second set of parallel tubes is within the range: 1.5 m<TL<2.5 m and the length PL of both the first 5 and second 6 steam/condensate manifold is comprised in the range: 8.0 m<PL<13.7 m. The first and second condenser panel are positioned with respect to each other such that there is an opening angle δ between the first and the second condenser panel within the range: 45°≤δ≤65° as shown on FIG. 1A.

Preferably, the delta-type heat exchanger unit is a self-supporting device. A self-supporting delta-type heat exchanger unit has to be construed as a HEXU that is designed to support its own weight, i.e. the steam/condensate manifolds 5,6 are designed to support the weight of the top duct and the weight of the first and second condenser panel. As a result, the self-supporting HEXU can be simply positioned with the first steam/condensate manifold 5 and second steam/condensate manifold 6 resting on for example a support frame or resting for example on the floor of a container.

In a second step b), a condenser module is designed by grouping a number UN of the delta-type heat exchanger units in rows next to each other. In some embodiments, as illustrated in FIG. 2 and FIG. 3, two heat exchanger units (UN=2) are grouped together to form a module while in alternative embodiments, as for example shown on FIG. 8, three heat exchanger units (UN=3) are grouped together.

The condenser module is further designed by defining a required number FN of air fans aligned along an axis parallel with the direction of the top ducts of the grouped delta-type heat exchangers. As there is one row of aligned fans for multiple rows of delta-type heat exchanger units, the number of required fans is kept to a minimum. In this way the power consumption is limited.

In a further step c), a first model of independent frame structure for supporting all delta-type heat exchanger units of one condenser module and/or designing a second model of independent frame structure for supporting all heat exchanger units of two condenser modules are designed. Alternatively, a third model of independent frame structure for supporting all heat exchanger units of three condenser modules is designed. In some embodiments, only the first model of frame structure is designed but in a preferred embodiment both the first and the second model of frame structures are designed as this increases the modularity. A model of a frame structure has to be construed as an open structure comprising supporting beams located at a height H1 with respect to a floor level and comprising legs attached to the supporting beams for holding the supporting beams at the height H1. The delta-type exchanger units can then be positioned on top of those supporting beams.

In step d) for a given steam flow from the power plant, a required number NMOD of condenser modules to condense the steam are determined.

In step e), a required number of first model NMODA and/or a required number of second model NMODB and/or a required number of third model NMODC of independent frame structures for supporting the required number NMOD of condenser modules are determined.

In step f), the delta-type heat exchanger units are assembled in a factory. The total number UTOT to be assembled is equal to UTOT=UN×NMOD. The assembly in the factory comprises the sub-steps of attaching a first end of each tube of the first condenser panel to the top duct 2, attaching a second end of each tube of the first condenser panel to the first steam/condensate manifold 5, attaching a first end of each tube of the second condenser panel to the top duct 2, attaching a second end of each tube of the second condenser panel to the second steam/condensate manifold 6. Attaching the tubes to the top duct and the steam/condensate manifold has to be construed as performing a vacuum tight connection. Attaching the tubes to the top duct and the steam/condensate manifold comprises the performance of shop welding.

In step g), each of the assembled delta-type heat exchanger units 1 is placed in a container for transportation to an installation site.

In a final step h), the air cooled condenser apparatus is erected at the installation site. This comprises sub-steps of positioning the required number of first and/or second and/or third independent frame structures, positioning the delta-type condenser units 1 of each of the condenser modules on top of the first and/or second and/or third independent frame structures, and, for each condenser module, installing the required number FN of fans.

The invention claimed is:

1. An air-cooled condenser apparatus for condensing a steam flow from a steam turbine wherein the air-cooled condenser apparatus is erected along a vertical axis Z perpendicular to a floor level including two orthogonal axes X and Y perpendicular to the axis Z, said air-cooled condenser apparatus comprising:

one condenser module or a series of condenser modules ACCM(i) with i=1 to NMOD and 2≤NMOD, said one condenser module or each condenser module ACCM(i) of said series of condenser modules including:

a) a series HEXU(j) of delta-type heat exchanger units with j=1 to UN and UN=2 or UN=3, forming a row of UN delta-type heat exchanger units extending along a direction parallel with said axis X, and wherein each delta-type heat exchanger unit of said series HEXU(j) of delta-type heat exchanger units includes:

a first set of parallel tubes and a second set of parallel tubes that are inclined with respect to said vertical axis Z and are positioned so as to have an opening angle δ between the first set and the second set of parallel tubes, the opening angle δ in a range 45°≤δ≤65°, and wherein the tubes of said first set and second set of parallel tubes have a tube length TL in a range of 1.5 m<TL<2.5 m, and said tubes include fins, a top duct extending in a direction parallel to said axis Y and connected to an upper end of each tube of said first set of parallel tubes and connected to an upper end of each tube of said second set of parallel tubes, a first steam/condensate manifold extending in a direction parallel to said axis Y and connected to a lower end of each tube of said first set of parallel tubes, and a second steam/condensate manifold extending in a direction parallel to said axis Y and connected to a lower end of each tube of said second set of parallel tubes, said first steam/condensate manifold and said second steam/condensate manifold have a length PL that is in a range of 8.0 m<PL<13.7 m, and b) a series of fans FAN(k) of at least two fans and at most four fans, wherein the fans of said series of fans FAN(k) are aligned along an axis parallel with the Y axis and wherein each fan of said series of fans is configured to generate an air flow through all delta-type heat exchanger units of said series HEXU(j) of delta-type heat exchanger units, and a support structure configured for positioning the delta-type heat exchanger units of said one condenser module or the delta-type heat exchanger units of said series of condenser modules ACCM(i) at a height H1, measured along the Z axis, that is equal to or larger than four meter above said floor level, wherein said support structure includes a series of independent frame structures FRS(m) with m=1 to NFR, wherein said series of independent frame structures is configured for supporting a total number NTOT=UN×NMOD of delta-type heat exchanger units, and wherein the number NFR of said independent frame structures is in the range Ceiling(NMOD/3)≤NFR≤NMOD, wherein said series of independent frame structures FRS(m) includes at least one frame of a model B and a plurality of frames of a model C, and wherein said frame of model B is configured to support the series HEXU(j) of delta-type heat exchanger units of two condenser modules, and said frame of model C is configured to support the series HEXU(j) of delta-type heat exchanger units of three condenser modules.

2. An air-cooled condenser apparatus for condensing a steam flow from a steam turbine wherein the air-cooled condenser apparatus is erected along a vertical axis Z perpendicular to a floor level including two orthogonal axes X and Y perpendicular to the axis Z, said air-cooled condenser apparatus comprising:

one condenser module or a series of condenser modules ACCM(i) with i=1 to NMOD and 2≤NMOD, said one condenser module or each condenser module ACCM(i) of said series of condenser modules including:

c) a series HEXU(j) of delta-type heat exchanger units with j=1 to UN and UN=2 or UN=3, forming a row of UN delta-type heat exchanger units extending along a direction parallel with said axis X, and wherein each delta-type heat exchanger unit of said series HEXU(j) of delta-type heat exchanger units includes:

a first set of parallel tubes and a second set of parallel tubes that are inclined with respect to said vertical axis Z and are positioned so as to have an opening angle δ between the first set and the second set of parallel tubes, the opening angle δ in a range 45°≤δ≤65°, and wherein the tubes of said first set and second set of parallel tubes have a tube length TL in a range of 1.5 m<TL<2.5 m, and said tubes include fins, a top duct extending in a direction parallel to said axis Y and connected to an upper end of each tube of said first set of parallel tubes and connected to an upper end of each tube of said second set of parallel tubes, a first steam/condensate manifold extending in a direction parallel to said axis Y and connected to a lower end of each tube of said first set of parallel tubes, and a second steam/condensate manifold extending in a direction parallel to said axis Y and connected to a lower end of each tube of said second set of parallel tubes, said first steam/condensate manifold and said second steam/condensate manifold have a length PL that is in a range of 8.0 m<PL<13.7 m, and d) a series of fans FAN(k) of at least two fans and at most four fans, wherein the fans of said series of fans FAN(k) are aligned along an axis parallel with the Y axis and wherein each fan of said series of fans is configured to generate an air flow through all delta-type heat exchanger units of said series HEXU(j) of delta-type heat exchanger units, and a support structure configured for positioning the delta-type heat exchanger units of said one condenser module or the delta-type heat exchanger units of said series of condenser modules ACCM(i) at a height H1, measured along the Z axis, that is equal to or larger than four meter above said floor level, wherein said support structure includes a series of independent frame structures FRS(m) with m=1 to NFR, wherein said series of independent frame structures is configured for supporting a total number NTOT=UN× NMOD of delta-type heat exchanger units, and wherein the number NFR of said independent frame structures is in the range Ceiling(NMOD/3)≤NFR≤NMOD, wherein said series of independent frame structures FRS (m) includes a first frame of a first model and a second frame of a second model, the first model configured to support the series HEXU(j) of delta-type heat exchanger units of a first number of condenser modules, and the second model configured to support the series HEXU(j) of delta-type heat exchanger units of a second number of condenser modules, the first number of condenser modules different than the second number of condenser modules.

3. An air-cooled condenser apparatus according to claim 2, wherein said series of independent frame structures FRS (m) includes a third frame of a third model, wherein the first number of condenser modules is one, the second number of condenser modules is two, and said frame of the third model is configured to support the series HEXU(j) of delta-type heat exchanger units of three condenser modules.

4. An air-cooled condenser apparatus according to claim 2, wherein each condenser module ACCM(i) of said series of condenser modules includes a box-shaped frame structure attached to said series of independent frame structures FRS(m), and wherein said box-shaped frame structure includes a fan deck located at height H2 with respect to said floor level and wherein H2≥7 m, and wherein said fan deck is configured to support said series of fans FAN(k) so as to generate, when in operation, an induced air draft through the delta-type heat exchanger units.

5. An air-cooled condenser apparatus according to claim 2, wherein NFR>1 and wherein each independent frame structure of said series of independent frame structures FRS(m) includes means for attaching one or more of said series of fans FAN(k) at a height H3 with respect to said floor level and wherein H1>H3>2 m.

6. An air-cooled condenser apparatus according to claim 2, wherein, for each of the delta-type heat exchanger units of said one condenser module or of said series of condenser modules, said first set of parallel tubes includes a first group of primary tubes and a first group of secondary tubes and said second set of parallel tubes includes a second group of primary tubes and a second group of secondary tubes, and wherein said top duct includes:

a first top duct section having an entrance opening on one end to receive steam and a cover on the other end, and wherein the first top duct section (2*a*) is connected to said first group of primary tubes and to said second group of primary tubes, and a second top duct section including an exit opening for evacuating non-condensable gases and/or non-condensed steam, and wherein said second top duct section is connected to said first group of secondary tubes and to said second group of secondary tubes.

7. An air-cooled condenser apparatus according to claim 2, wherein the top duct of each delta-type heat exchanger unit includes an entrance opening for receiving steam, and wherein the entrance opening has a cross-sectional area S in the range of 0.12 $m^2 \leq S \leq 0.5$ $m^2$.

8. An air-cooled condenser apparatus according to claim 2, further including a main steam duct elongated along an axis parallel with said axis X, and wherein one end of each top duct of each delta-type heat exchanger unit of each module is connected with said main steam duct.

9. An air-cooled condenser apparatus for condensing a steam flow from a steam turbine wherein the air-cooled condenser apparatus is erected along a vertical axis Z perpendicular to a floor level including two orthogonal axes X and Y perpendicular to the axis Z, said air-cooled condenser apparatus comprising:

one condenser module or a series of condenser modules ACCM(i) with i=1 to NMOD and 2≤NMOD, said one condenser module or each condenser module ACCM(i) of said series of condenser modules including:

e) a series HEXU(j) of delta-type heat exchanger units with j=1 to UN and UN=2 or UN=3, forming a row of UN delta-type heat exchanger units extending along a direction parallel with said axis X, and wherein each delta-type heat exchanger unit of said series HEXU(j) of delta-type heat exchanger units includes:

a first set of parallel tubes and a second set of parallel tubes that are inclined with respect to said vertical axis Z and are positioned so as to have an opening angle δ between the first set and the second set of parallel tubes, the opening angle δ in a range 45°≤δ≤65°, and wherein the tubes of said first set and second set of parallel tubes have a tube length TL in a range of 1.5 m<TL<2.5 m, and said tubes include fins, a top duct extending in a direction parallel to said axis Y and connected to an upper end of each tube of said first set of parallel tubes and connected to an upper end of each tube of said second set of parallel tubes, a first steam/condensate manifold extending in a direction parallel to said axis Y and connected to a lower end of each tube of said first set of parallel tubes, and a second steam/condensate manifold extending in a direction parallel to said axis Y and connected to a lower end of each tube of said second set of parallel tubes, said first steam/condensate manifold and said second steam/condensate manifold have a length PL that is in a range of 8.0 m<PL<13.7 m, and f) a series of fans FAN(k) of at least two fans and at most four fans, wherein the fans of said series of fans FAN(k) are aligned along an axis parallel with the Y axis and wherein each fan of said series of fans is configured to generate an air flow through all delta-type heat exchanger units of said series HEXU(j) of delta-type heat exchanger units, and a support structure configured for positioning the delta-type heat exchanger units of said one condenser module or the delta-type heat exchanger units of said series of condenser modules ACCM(i) at a height H1, measured along the Z axis, that is equal to or larger than four meter above said floor level, wherein said support structure includes a series of independent frame structures FRS(m) with m=1 to NFR, wherein said series of independent frame structures is configured for supporting a total number NTOT=UN× NMOD of delta-type heat exchanger units, and wherein the number NFR of said independent frame structures is in the range Ceiling(NMOD/3)≤NFR≤NMOD, wherein said series of independent frame structures FRS (m) includes a first number of frames of a first model and a second number of frames of a second model, the first model configured to support the series HEXU(j) of delta-type heat exchanger units of a first number of condenser modules, and the second model configured to support the series HEXU(j) of delta-type heat exchanger units of a second number of condenser modules, the first number of condenser modules different than the second number of condenser modules, the first number of frames different than the second number of frames.

10. An air-cooled condenser apparatus according to claim 9, wherein said series of independent frame structures FRS (m) includes a third frame of a third model, wherein the second number of condenser modules is two, and said frame of the third model is configured to support the series HEXU(j) of delta-type heat exchanger units of three condenser modules.

11. An air-cooled condenser apparatus according to claim 9, wherein at least one of (i) the first number of condenser modules is two or three or (ii) the second number of condenser modules is two or three.

* * * * *